US011230302B2

(12) United States Patent
Rudibaugh et al.

(10) Patent No.: US 11,230,302 B2
(45) Date of Patent: Jan. 25, 2022

(54) RAILWAY CAR TRUCK SYSTEM

(71) Applicant: ADVANCED TRUCK SYSTEMS CORP., West Chester, PA (US)

(72) Inventors: John Rudibaugh, West Chester, PA (US); Manny Tavares, Doylestown, PA (US); Wayne Murphy, Pottstown, PA (US); Perry Levitt, West Chester, PA (US)

(73) Assignee: Advanced Truck Systems Corp., West Chester, PA (US)

( * ) Notice: Subject to any disclaimer, the term of this patent is extended or adjusted under 35 U.S.C. 154(b) by 0 days.

(21) Appl. No.: 16/073,653

(22) PCT Filed: Jan. 27, 2017

(86) PCT No.: PCT/US2017/015343
§ 371 (c)(1),
(2) Date: Jul. 27, 2018

(87) PCT Pub. No.: WO2017/132512
PCT Pub. Date: Aug. 3, 2017

(65) Prior Publication Data

US 2021/0101629 A1 Apr. 8, 2021

Related U.S. Application Data

(60) Provisional application No. 62/287,733, filed on Jan. 27, 2016.

(51) Int. Cl.
*B61F 5/40* (2006.01)
*B61F 3/02* (2006.01)

(52) U.S. Cl.
CPC . *B61F 5/40* (2013.01); *B61F 3/02* (2013.01)

(58) Field of Classification Search
CPC ..... B61F 5/02; B61F 5/04; B61F 5/16; B61F 5/38
See application file for complete search history.

(56) References Cited

U.S. PATENT DOCUMENTS 4,237,791 A * 12/1980 Jackson ..... B61F 5/305 105/168
4,458,604 A * 7/1984 Cope ..... B61F 5/38 105/168

(Continued)

FOREIGN PATENT DOCUMENTS

EP 0258502 B1 2/1992
EP 1479586 B1 12/2005

*Primary Examiner* — Robert J McCarry, Jr.
(74) *Attorney, Agent, or Firm* — Bonini IP Law, LLC; Frank J. Bonini, Jr.

(57) ABSTRACT

A steering mechanism for a rail vehicle includes two steering arms, each including a pair of support arms that have a joining component with a recess. The two steering arms are articulated in a manner that maintains a minimum separation between the steering arms so that the arms can rotate relative to one another. The minimum separation is maintained by an insert that installs into the joining component recesses components of each of the steering arms. The insert has two sides, each side having a flexible material and forming a shape that mates with the recess. The insert provides resistance to the rotation between the first and second steering arms, and the resistance depends on the stiffness of the flexible material of the insert.

19 Claims, 13 Drawing Sheets

(56) References Cited

U.S. PATENT DOCUMENTS

| | | | | | |
|---|---|---|---|---|---|
| 4,628,824 | A * | 12/1986 | Goding | B61F 5/52 | 105/168 |
| 4,926,756 | A | 5/1990 | Smith | | |
| 5,000,097 | A | 3/1991 | List | | |
| 5,524,552 | A * | 6/1996 | Weber | B61F 3/00 | 105/176 |
| 7,096,795 | B2 * | 8/2006 | Wike | B61F 5/36 | 105/168 |
| 8,336,464 | B1 * | 12/2012 | Xing | B61F 5/52 | 105/168 |
| 2012/0325107 | A1 | 12/2012 | Wicks | | |

* cited by examiner

RAILWAY CAR TRUCK SYSTEM

RELATED APPLICATIONS

This application claims the priority benefit of U.S. provisional application No. 62/287,733, filed Jan. 27, 2016, titled "Railway Car Truck System," ("the '733 provisional") the entire contents of which are hereby incorporated by reference.

TECHNICAL FIELD

The present disclosure generally relates to truck systems for railway cars. More specifically, the present disclosure relates to a steering arm assembly and related components for the railway truck systems of a railway car.

BACKGROUND

A rail vehicle (also referred to as a rail car) is a vehicle that is capable of traveling along the rails or tracks of a railway. Rail vehicles can include locomotives, freight cars, passenger cars, road-rail vehicles, and high speed trains, to name but a few examples. Rail vehicles generally include a rail truck (or trucks) and a vehicle body (or a car body), which may or may not be affixed to the trucks. The rail truck is a chassis or framework that allows the rail vehicle to travel forward or backward along the tracks of a railway. Rail trucks can include a variety of components, including a bolster, side frames, wheel sets (e.g., wheels and axles), and steering arms, and are used to support the car body and transmit and/or absorb loads between the car body and the rail. In one example of operation, a rail truck may include two wheel sets, each wheel set comprising an axle and two opposing wheels. One such truck may be located at the front of a rail car, and another may be located at the rear of the rail car, such that two wheel sets (or four wheels) support the front portion of the rail vehicle, and two wheel sets (or four wheels) support the rear portion of the rail vehicle.

Present trucks for railway vehicles have functional limitations that result from their method of manufacture. For example, many trucks are manufactured from casted components (i.e., components made via a casting process). Such cast trucks may not be able to achieve the dimensional reproducibility of a machined part. As a result of this imprecision in casting processes, the rail industry generally allows looser tolerances to be acceptable. In allowing such looser tolerances, the rail components tend to contribute to unpredictable performance and shorter product and component life.

Further, some rail trucks employ a steering mechanism to control the stiffness or flexibility between the wheel sets on the truck. That is, the steering mechanisms can help control how much movement can occur between the front and rear wheel sets on a particular truck. How the steering is controlled can be useful, depending on how the truck is intended to be used. For instance, some rail trucks may be used primarily on tracks that involve a relatively high level of turns (e.g., rail cars used in mining, or that may be intended for mountain travel). As such, these trucks may be configured with steering mechanisms that allow for more flexibility between the two wheel sets, which can reduce friction loads and other stresses as the rail car travels along turns. Alternatively, some rail trucks may be used primarily on straight track where they may travel at higher speeds. For such trucks, it may be desirable to employ a stiffer steering configuration to reduce hunting, vibrations, or other factors that can lead to frictional forces that can inhibit the straight-line traveling efficiency of the vehicle. However, while such steering mechanisms can be designed to be either stiff or flexible, such trucks are not readily adaptable. That is, a truck design that employs a stiff steering design cannot be readily adapted to accommodate a more flexible steering design and vice-versa.

SUMMARY

The present application describes various features of a particular rail truck design that will be referred to as the advanced truck system ("ATS"), as well as its components, method of manufacture, and methods of use and operation. In one particular example, the present application describes a rail steering mechanism for use with the ATS (or other trucks) that is adaptable in terms of steering stiffness and flexibility. That is, the steering mechanism can be adapted to provide a stiffer steering configuration or a more flexible steering configuration without having to significantly modify the various other aspects and components of the ATS truck, or otherwise redesign significant aspects of the steering mechanism or truck assembly.

In some examples, the steering mechanism operates in connection with a rail truck that includes two side frames and two opposing wheel sets. The wheel sets are arranged so that, in a resting configuration, they are essentially parallel with one another, such that the four wheels of the rail truck are generally configured to travel in the same general direction. The steering mechanism is connectable to the truck, for example, via a bolted attachment at the roller bearing adapters of the truck.

In some forms, the steering mechanism includes two steering arms, which steering arms may have a V-shaped configuration (though other configurations can be used in other forms). In some examples, the steering arms are configured so that they can be fabricated, or formed via a machining process. Each steering arm includes a support with two braces that extend from a center vertex toward opposing side frames at one end of the truck. The two steering arms have joining components that are configured to connect together at a central articulation point of the steering mechanism. The joining components may be positioned at or around the vertex that forms the V-shape for each of the steering arms, for example. The two steering arms can connect to one another via a bolted arrangement, such that the connection involves aligning the two connection points, and passing a bolt or other articulation mechanism through the two joining components, thereby allowing each steering arm to be an extension of the other.

As noted, each of the steering arms includes a joining component. In some cases, the joining components can form respective male and female connector components, such that the steering arm having the male connector component is configured to install into the female connector component of the opposing steering arm. However, in other cases, the joining component for each of the steering arms includes a female connector, such as a cup-shaped connector component, that is configured to receive an insert. In this manner, the steering arms may be similar, or even identical (or virtually identical) to one another. The insert can include opposing sides, each having a flexible and/or elastomeric component that is configured to fit within the cup-shaped connectors of the steering arms. The insert (or the sides of the insert) may have a conical shape, and can provide a degree of flexibility or stiffness at the articulation point. The degree of flexibility can vary and depend on the flexibility of the insert, in particular, the flexibility of the flexible material that forms the portion of the insert that installs into the cup-shaped connector component. As such, a truck manufacturer can select a particular insert to meet the particular desired properties for the truck. That is, where the truck is to be designed for use on generally straight track such that stiffer steering properties are desired, then the insert can be selected to have a material that is generally of a stiffer nature. Alternatively, where the truck is designed to be more efficient around tighter turns such that a more flexible steering mechanism is desired, the insert can be selected from softer, or more flexible materials.

This application also relates to rail car trucks that utilize the above described steering arms and steering mechanism, and some embodiments also relate to the rail vehicles that ride upon such rail trucks.

BRIEF DESCRIPTION OF THE DRAWINGS

FIGS. 5A and 5B are isometric and side views of an insert, and FIG. 5C shows the insert with a portion removed to show internal structure. FIG. 5D shows a side view of the insert interacting with an articulation mechanism.

DETAILED DESCRIPTION

Figure 1B:
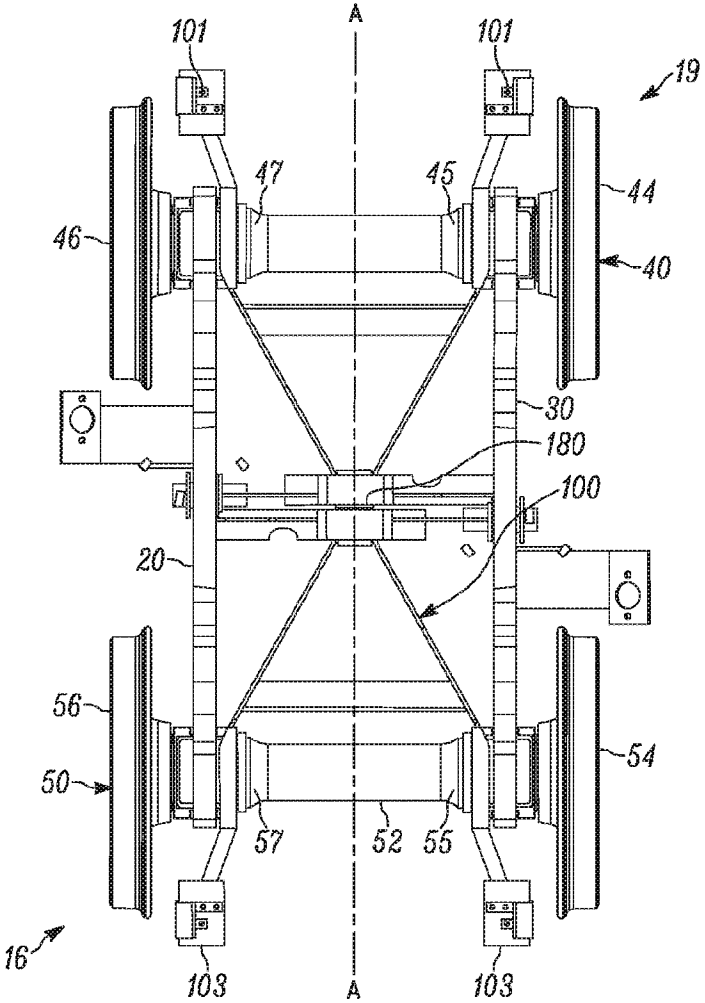
FIGS. 1A and 1B are isometric and top views, respectively, of a rail car truck assembly in accordance with examples described in this application.

Fabrication of a truck and its components in an industry dominated by castings can provide several advantages. For example, machined components can provide precise and repeatable tolerances. These advantages will permit a controlled, stable and higher speed performance as well as extend component part life including wheel sets, damping systems and wear components. Further, fabrication of the truck reduces development time and production time. Part modification, prototyping and testing are greatly accelerated. Accordingly, the industry can benefit from a fabricated rail truck that is not limited by US foundry capacity. In particular, the industry can benefit from fabricated truck systems for railway cars that can meet new AAR standards, such as M-976 or Rule 88 of the AAR Office Manual as well as proposed rules that expand the scope of M-976.

By using a fabrication there is an assurance of material quality as well as abundant availability of production stock. High quality nonporous metal stock, porosity being an ongoing issue with cast parts, is readily available. A diverse amount of alternate materials is also available. Use of nonstandard steels, lighter in weight and stronger in physical properties can be considered as opportunities.

The rail industry can also benefit from a lighter freight car truck. Certain examples of the ATS fabricated truck can be as much as 1,500 pounds lighter than 3 piece cast trucks. This feature can reduce railcar weight by as much as 3,000 pounds, and is achieved by reducing plate size where appropriate and adding of lightening holes. The reduction in weight allows for diesel fuel savings and increased payloads.

The rail industry can also benefit from an improved railway truck, such as the ATS, that has a set of design features that work in concert to provide improved steering and handling characteristics, particularly beneficial for high speed operation, negotiating curves, reducing hunting and in extending wheel and rail life. Specific design ranges can be determined as optimal, such as plate thickness, angles of attack and distances between functional parts.

The rail industry can also benefit from a steering truck like the ATS. Steering arms have a connection to each axle, via a bearing adapter, with a resilient component between the opposing steering arms that provide equal and opposite yawing movements. The current design with a cylindrical spring enclosed under compression in a metal sleeve can be modified, altered or changed to improve performance. Torque can be applied to the installed part, dimensions of the part can be optimized, and preferred material choices can be selected. New designs involving rubber blocks replacing the cylindrical spring may also provide steering advantages.

Current cast side frames strive to be rigid to reduce hunting, however this worsens curving, twist and roll, and pitch and bounce. Accordingly, the rail industry can benefit from a non-rigid side frame (e.g., as employed in examples of the ATS) that disassociates the two side frames from each other allowing free and independent movement which imparts improved performance on M-976 related tests. Transverse arms of a steering mechanism, described below, may extend between the side frames. An optimal width between these transverse arms could provide improved or even ideal performance.

The rail industry can also benefit from an improved non-linear damping system like that of the ATS, which can be custom designed for specific rail service. Inhibiting, reducing, and/or eliminating unpredictable friction damping, can help limit and/or minimize the impacts of associated metal springs going solid, and can allow for a smoother more controlled ride. Specifically tuned hydraulics and precisely designed elastomeric damping springs can replace metal springs and unpredictable friction damping. Optimal damping can provide improved or even ideal performance in the ATS.

Coupler height is established in the AAR's MSRP's. The ATS transom side frame platform holding the polymer spring, on which the bolster rides, can be designed to set higher or lower depending on the need of the user. Components can also be designed to retrofit already cut side frames.

Some examples of the ATS include a removable device to capture the steering arms. In existing trucks, the steering arms are typically disassembled before being removed from the truck. By making this configuration accessible, the ATS improves ease of assembly and repair.

A further advantage of the ATS includes the use of removable pins to capture the brake beam which allows for easy installation and removal. This is made possible due to the ATS truck brake rigging system being located outboard of the wheels. The brake system may also include brakes that hang and are applied in tension as opposed to compression. This may help to solve an industry hot issue of asymmetric wheel wear.

Some embodiments of the ATS include wear components found on various locations of the truck. These parts can be made with specific and optimal dimensions and be designed to solely work within our fabrication. For example, a replaceable pad between the side frame and the bolster, not found on the original fabricated truck can be employed. There is also a polymer sleeve on the transverse side frames plug which is inserted into its opposing side frame, the material and physical properties of which can be selected to provide advantages or desired functionality. These and other advantages can be achieved by various embodiments of the ATS.

In some examples, the ATS incorporates inboard bearings, resilient nonmetallic secondary springs, dissociated side frames, steering arms, and a stamped bolster. In some embodiments, the ATS incorporates all of the design features described herein into an inboard bearing fabricated truck, and the design features are believed to have a synergistic effect that enables the truck to meet or exceed recent AAR standards, such as M-976 for railcars having a 286,000 lb. gross rail load rating.

The ATS may include various additional features that offer improvements over other truck systems. Some of these features are described below.

Bolster location above side frames—The ATS, in some examples, has a bolster that is positioned above the side frames. Other three piece trucks, including those that have received M-976 approval, have the bolster located lower than the top of the side frames and engaged in the side frame opening. Even the new trucks that are part of the AAR Improved Freight Car Truck Strategic Research Initiative (SRI) have their bolsters located lower than the top of the side frames like other three-piece trucks. With a bolster lower than the top of the side frames, it can be difficult to locate the steering arms under the bolster as they are now located on the ATS truck. It is also difficult to maintain the body centerplate engagement with the ATS bolster should it be lowered significantly and still keep the coupler height on existing freight cars within the required range. This feature can also facilitate locating the steering arms under the bolster as described in more detail below.

Low friction interface supporting vertical load of freight car body located approximately at the position of a standard side bearing which is 25 inches laterally from centerline of car—Trucks often support the vertical load of the car body via the centerplate. However, in some aspects, the ATS supports the load of the freight car body at the standard side bearing location. This location for the vertical load support makes the ATS truck easy to retrofit to existing freight cars just as it was for the test cars at the Association of American Railroads Transportation Technology Center in Pueblo, Colo. (TTCI). The fact that the vertical load has a direct path from the car body interface, through the spring, and directly to the side frame could be considered significant as it brings up the inboard location of the roller bearings.

Special elastomeric damping spring secondary suspension—Certain embodiments of the ATS employ an elastomeric damping spring that is configured to provide a specific force deflection configured to operate in connection with the other features of the ATS.

Side frame—The side frames of the ATS can be formed from 3-inch-thick steel plate. The shape of the side frames can be seen in FIGS. 1-8 of the '733 provisional, and is discussed throughout the '733 provisional and its appendices. In some aspects, the shape of the side frames is configured to lighten the overall weight of the truck. The side frames can be fabricated from plate steel, but in some forms can also be formed via casting or a combination of fabrication and casting. In one embodiment, the design of the side frames is configured to take advantage of modern manufacturing capabilities where very accurate design dimensions can be maintained. The side frames may include transverse members that control the rotation of the side frames along their axes parallel to the longitudinal centerline of the freight car while allowing rotation of the side frames along their axes transverse to the centerline of the freight car. This transverse rotation can help allow the ATS truck to negotiate less than optimum track geometry. In some examples, the ends of the transverse members are welded to each side frame and enter a hole in the opposite side frame with a fit controlled by a nonmetallic bushing.

Side frame transverse arms—Some examples of the ATS include transverse arms that are welded to one side frame and connect to the opposite side frame with via a unique connection, as shown in FIGS. 1-8 of the '733 provisional, and described herein. The transverse arms can be used to stabilize the side frames from rocking on the adapters. The transverse arms can be connected in a "loose" manner to the opposite side frame to facilitate the side frames rotating independently of each other making it possible to negotiate rough track. Wheel load equalization tests performed at the TTCI include data related to this performance.

Primary suspension—The ATS includes a primary suspension that relates to the interface between the side frame and roller bearing adapter. The primary suspension includes an elastomeric damping and sliding feature. The primary suspension, in some examples, is retained in place by a cylindrical boss fitted into a cylindrical cavity in the pedestal roof of the side frame. Other embodiments include dropping the sliding feature so as to eliminate any dependency on friction which is hard to control. Also, the elastomeric material of the original design can take on a variety of forms to allow for movement of the axles relative to the side frames and to each other allowing them to assume an essentially radial geometry when the ATS truck is negotiating curves.

Steering arms—Certain aspects relating to the steering arms of the ATS, including how the steering arms attach to the inboard side of the roller bearing adapters and their location under the bolster, are shown in FIGS. 1-8 of the '733 provisional, and further discussed throughout this application and its appendices. The details concerning how the two portions of the steering arms are attached to each other have yielded very good results obtained during curve resistance tests. This application also describes more details regarding certain embodiments of a steering mechanism that includes multiple steering arms, and in particular, the connection between the multiple steering arms.

Roller bearing adapters—Some examples of the ATS include rolling bearing adapters that utilize a sliding interface with the primary suspension. In some embodiments, the roller bearing adapters can have a flat upper surface that interfaces with the primary suspension. The primary suspension can be installed on the roller bearing seat of the axle similar to a standard roller bearing, except that the roller bearing seat is located inboard of the wheels rather than outboard as is the case for the standard wheel set.

Roller bearing—In some examples, the ATS utilizes roller bearings. The roller bearings can be utilized in connection with an inboard connection of the steering arms and can be configured to a specific size based on the intended application.

Wheel sets—The ATS includes wheels and axles that may have different sizes of bores and wheel seat dimensions compared to standard wheel sets, as demonstrated in FIGS. 1-8, and further discussed throughout this application and its appendices.

Brake rigging—Some examples of the ATS operate with a tension based connection between brake beams. Given the tension connection and the fact that the brake beams of the ATS truck are of the hanger type, the ATS brake rigging can be used to address the asymmetric wheel wear problem that exists for other three-piece outboard roller bearing trucks with the compression connection between brake beams. The ATS truck is configured to provide improved access to the brake shoes by locating the brake beams and brake shoes outboard of the wheels of the truck, which makes these components easily accessible given that the side frames are not in the way.

Method of manufacturing—The present disclosure also presents methods for making the components of the ATS, for example, the bolster and side frame components. In some examples, the ATS components are fabricated and employ unique techniques not applied to other freight car truck systems, as described throughout this application and its appendices.

Interface between the car body and the truck bolster—The interface between the car body and the ATS truck bolster exists, in some forms, at the standard side bearing spacing for freight cars in the North American interchange system, which is about at 25 inches laterally from the centerline of the rail car. As a result, the interface utilizes a vertical load adapter made up of a series of plates. The plates may have a pair of holes in alignment with each other and the holes on the body bolster of the freight car body. These holes allow for bolts which attach the vertical load adapter to the body bolster and provide for a simple and nearly universal way to adapt or retrofit the ATS truck to virtually any new or existing rail car. The base plate of the vertical load adapter rests on a nonmetallic plate of the truck bolster and has a length and width that covers the entire surface of the nonmetallic plate. Thus the contact stress between the vertical load adapter and the nonmetallic plate can be reduced such that the body bolster of the car body and the truck bolster can rotate relative to each other with relatively low levels of resistance, or at least with a controlled resistance based on the coefficient of friction of the nonmetallic material Interface between the body centerplate of the rail car—In some examples, this interface includes a ring at the centerline of the truck bolster that aligns with the body centerplate such that a standard body centerplate can be utilized. This can help simplify the retrofit to existing freight cars. Since the vertical loads are carried at the vertical load adapter, the body centerplate may carry no, or virtually no, vertical load. The interface between the truck bolster ring and the body centerplate also provides for the transfer of longitudinal and lateral loads that result from pulling and pushing the freight car in service and from braking of the freight car. That no (or essentially no) vertical loads are carried at the centerline of the truck bolster in some examples allows for a lightweight truck bolster design compared to a standard three-piece truck.

Secondary suspension—In some examples, the secondary suspension of the ATS truck includes an elastomer spring and a hydraulic damper. The elastomer or rubber spring is mounted between the truck bolster and side frame such that the load from the car body is transmitted directly into the side frame with no, or at least very little, eccentricity. The elastomer or polymer spring can be mounted in a range of from completely vertical to a slight inward angle of several degrees. A slight inward angle provides both vertical and lateral reaction forces helping to balance and stabilize the load from the car body. The elastomer spring also provides damping through the hysteretic energy absorption that is inherent in the material. The elastomer or rubber spring can take on a variety of different forms or embodiments. In one embodiment, the spring can use a Hytrel® type synthetic material processed in such a way as to provide optimized load and damping characteristics. In another, the spring can comprise a natural rubber material molded into a multi-layered spring with steel plates existing between the layers. In either embodiment, the property of the springs can be optimized for the application of the ATS to typical freight cars. In some examples, the hydraulic dampers, two per truck, can be mounted between the truck bolster and side frame at an angle such that, as with the secondary spring, damping is provided mainly in the vertical direction but with a significant component laterally. The characteristics of both the secondary spring and the hydraulic damper can be determined through dynamic numerical analysis in order to provide optimum truck performance for a variety of service conditions and to meet test criteria of the railroad industry.

Steering Mechanism Assembly

As noted above, certain aspects of the present application relate to the details of a steering mechanism assembly that can be used in connection with a rail car truck (e.g., the ATS). The examples of a steering mechanism described herein may improve the performance of the rail truck in terms of the ability to reduce the rolling resistance of the rail truck as it travels around bends or turns. Moreover, the described mechanism also may maintain efficient operation on straight or tangential track, such that the ability of the steering arm to flex on turns does not negatively impact wobble or vibration levels as a rail car travels at higher speeds along straightaways.

Further, the described steering mechanism provides adaptability to the users and/or the manufacturers of the rail car trucks, such that individual trucks can be built according to particular flexibility standards without involving major structural or design changes in the truck or the steering mechanism. That is to say, one truck can be manufactured to have stiffer parameters and another truck can be manufactured to have more flexible parameters simply by modifying out one part, an insert (or in some cases, a male connector), without changing or modifying or changing the other components of the steering mechanism or truck assembly. In this way, manufacturers can save time and expense by utilizing one truck design that will adapt to a variety of customer demands. That is, the manufacturing and design process can be repeatable for a variety of different trucks, with the only difference being the specific insert that is used in the connection.

Figure 1A:
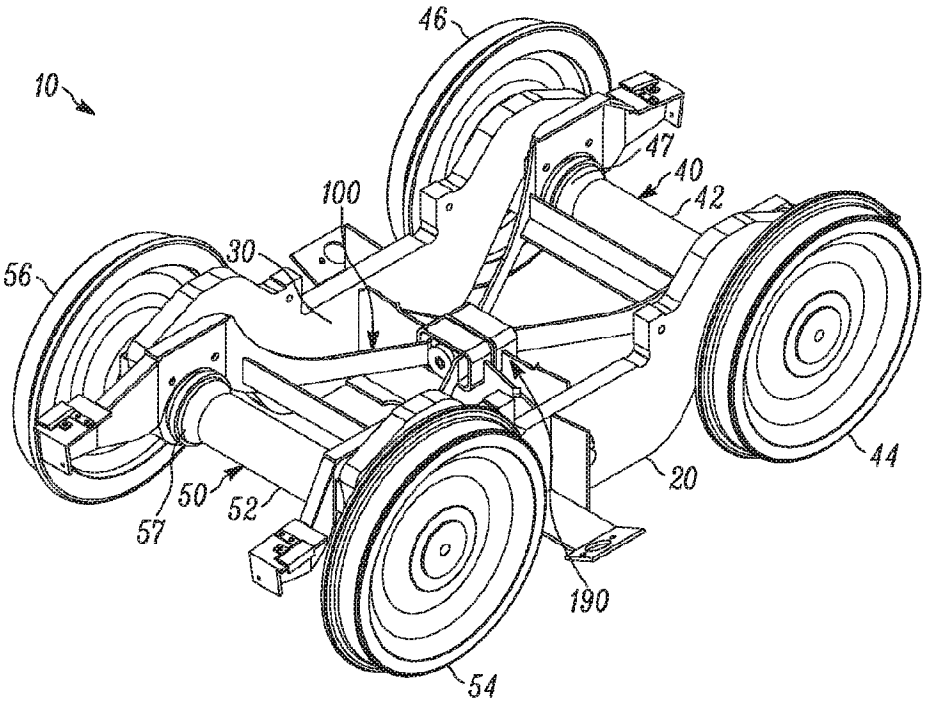

FIGS. 1A-6 show such a steering mechanism, and its relationship to a rail car truck. In particular, FIGS. 1A and 1B show an example of a rail car truck assembly 10 (also referred to for simplicity as "truck 10") that utilizes such a steering mechanism 100. Notably, FIG. 1A provides an isometric view of the truck assembly 10, and FIG. 1B shows a top view. The truck 10 includes two opposing side frames 20 and 30 that extend essentially parallel with one another and essentially parallel with a longitudinal axis A-A of the truck 10. The side frames 20/30 extend longitudinally from a first side 14 of the truck to a second side 16. On each of the first 14 and second 16 sides, wheel sets 40 and 50 span across the width of the truck 10. That is, a first wheel set 40 spans across the width of the first side 14 of the truck 10, and a second wheel set 50 spans across the width of the second side 16 of the truck 10.

The first wheel set 40 toward the first side 14 of the truck 10 includes an axle 42 and two wheels 44/46 on opposite sides of the axle. The wheels 44/46 are configured to travel and move the truck along the rails of a railway. The first wheel set 40 may also include roller bearings 45/47 that facilitate rotation of the axle 42 and wheels 44/46 relative to the truck 10. The roller bearings 45/47 may include adapters that facilitate attachment to other components of the truck 10, such as the steering mechanism 100. On the second side 16 of the truck 10, the second wheel set 50 has a similar, even identical configuration, including an axle 52 and two wheels 54/56 and roller bearings 55/57 toward the second side 16 of the truck 10.

The two wheels 44/46 and 54/56 of the two wheel sets 40/50 are linked so that they are essentially parallel to one another at all times. Accordingly, as the truck 10 travels along a curved track, the treads of the wheels 44/46 may experience resistance in the form of friction as they rotate in a direction that is not parallel with the rails themselves. Accordingly, the steering mechanism 100 is configured to allow the two wheel sets 40/50 to rotate, or yaw (e.g., rotate about a vertical axis of the truck 10) relative to one another so that the wheels can align closer to parallel with the rails, thereby reducing the rolling resistance of the truck 10. This ability to allow yawing rotation is accommodated by way of a connection point at or around the center 18 of the truck 10 that attaches two steering arms of the steering mechanism assembly 100. In some forms, the steering mechanism 100 also allows freedom of movement and rotation in other dimensions (e.g., vertical rotation about an axis parallel with the wheel sets), which can also provide tangible benefits to the operation of the truck assembly.

It should be appreciated that the truck 10 shown in FIGS. 1A-B is but one example of a truck that can operate with the steering mechanism 100 that will be described below. It is contemplated that other trucks having other configurations could also be used in connection with the described technology. Moreover, the truck 10 of FIGS. 1A-B is shown and described with only a portion of the components that may make up the total truck 10. For example, the truck 10 may also include equipment including bolsters, load bearing assemblies, damping mechanisms, side frame pedestals, wear plates, and brake beams, for example.

Figure 13:
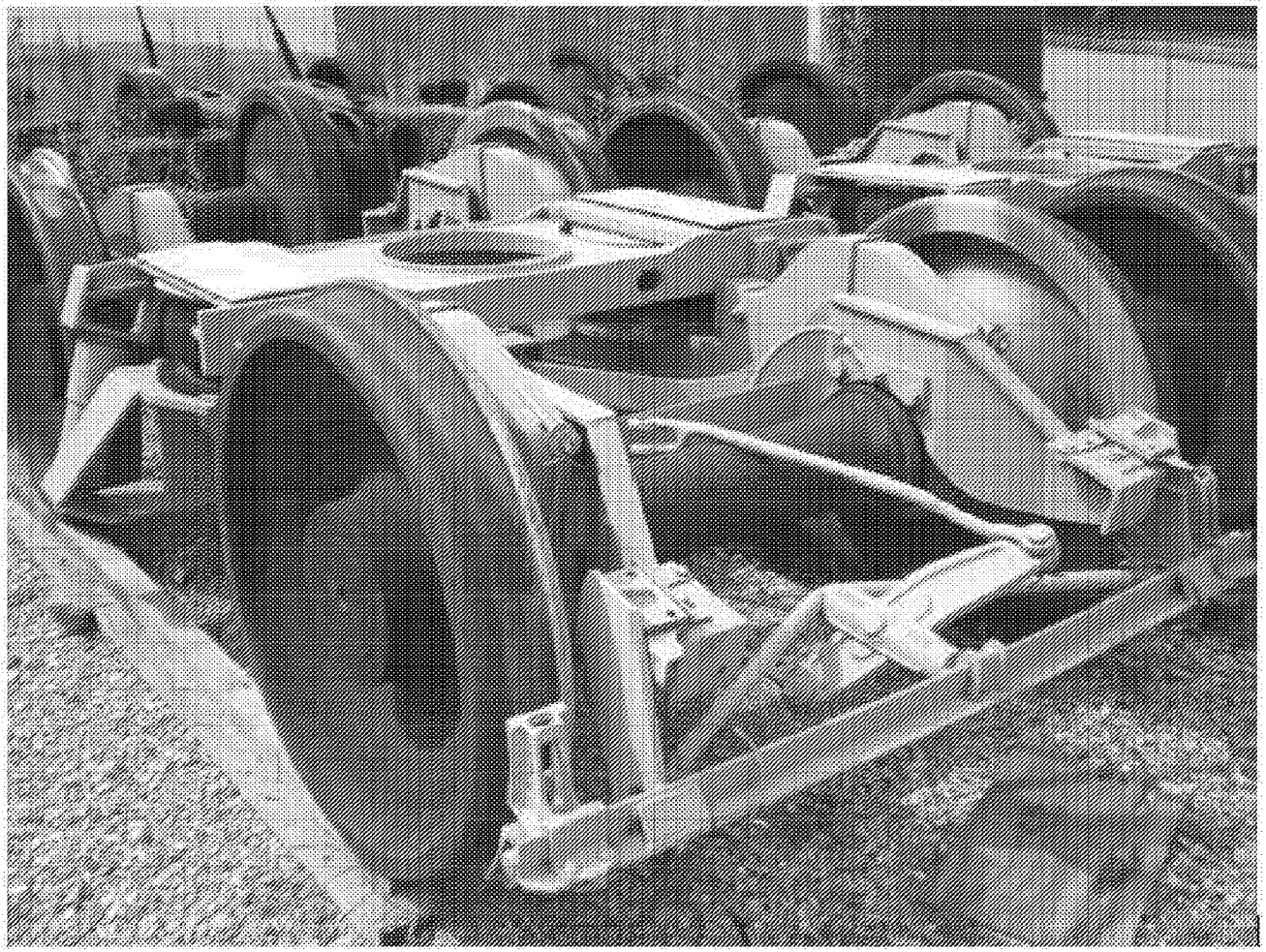
FIG. 13 is a photograph of a truck employing an outboard brake beam arrangement in accordance with examples described herein.

In one example, the truck assembly may include brake beams that attach to the truck assembly outboard of the wheel sets 40/50, relative to the center 18 of the truck. For example, FIG. 1B shows that the steering mechanism 100 includes linkages 101/103 on the first and second sides of the truck 10 that are adapted to connect with brake beams that will connect brake shoes that operate braking functionality of the truck 10. FIG. 13 is a photograph of such an arrangement of a brake beam that is outboard of the wheel sets. Because the brake beams and brake shoes can connect to the steering arm, the connected brake beams/shoes will align with the wheel sets as the truck 10 travels along a rail track, even where that track is curved. In some examples, the truck 10 will include tensile connectors that link the front and rear brake beams and apply tension thereto. The tension resulting from these tensile connectors can assist the brake beams, particularly the brake shoes, to maintain alignment with the wheel sets. In particular, the tension helps the brake shoes align with the wheel treads such that wear between the brake shoes and wheel flanges is eliminated. In an arrangement where the brake beams are inboard of the wheel sets and are connected by a compression member, the brake beams/shoes are forced apart laterally, which results in contact between the brake shoes on diagonally opposite wheel flanges. This situation can result in asymmetric wheel wear, which can result in problems in the railroad industry. In the case of the ATS, the steering mechanism causes the wheel sets to assume an essentially radial position on curved track. Thus the brake beams also assume this same position keeping the brake shoes aligned with the wheel treads even on curves.

Figure 2B:
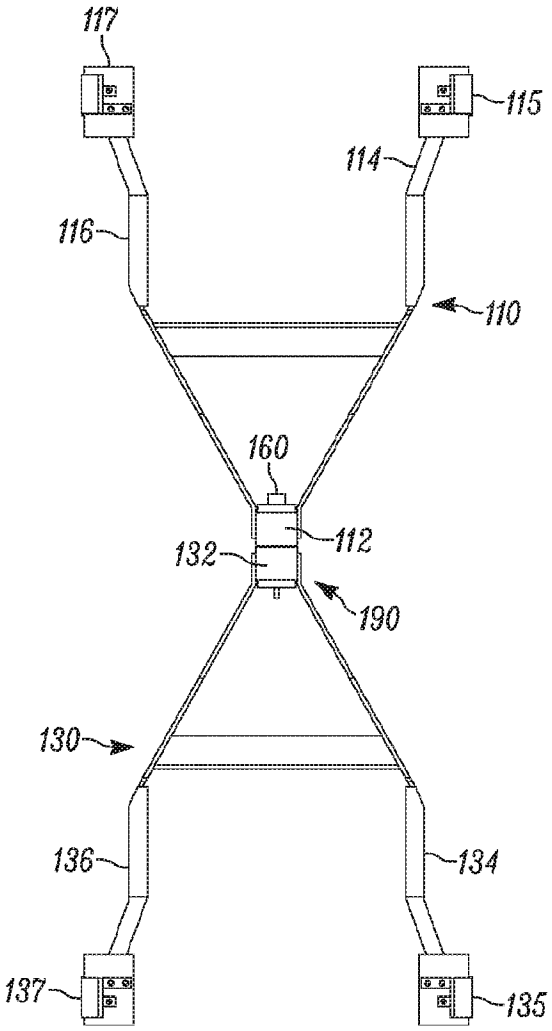
FIGS. 2A and 2B are isometric and top views, respectively, of a steering mechanism used in connection with the rail car truck assembly of FIGS. 1A and 1B.
Figure 2A:
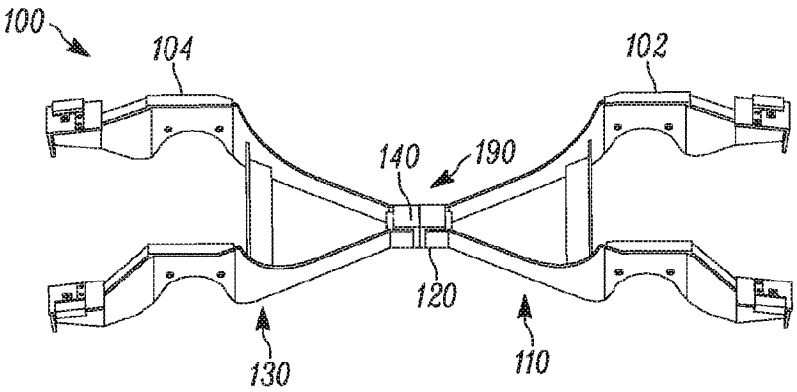

As noted, the steering assembly 100 allows the wheel sets of the truck to yaw with respect to one another so that the wheels of each wheel set can remain generally parallel (or close to parallel) with the tangent of the track as the track curves. This ability to steer is allowed by way of a two-piece nature of the steering mechanism 100, and the particular point of connection between the two pieces. FIGS. 2A and 2B show the steering mechanism 100 of FIGS. 1A and B removed from the truck 10. In particular, FIG. 2A shows a side isometric view of the steering mechanism 100, and FIG. 2B shows a top view, used in connection with the rail car truck assembly of FIGS. 1A and 1B. As shown, the steering mechanism 100 includes a first steering arm 110 on a first side 102, and a second steering mechanism 130 on a second side 104 opposite to the first side 102.

The steering arms 110/130 are shown arranged in a V-shaped configuration, such that each steering arm has a pair of support arms that extend at an angle from a toward respective arm ends that attach to the wheel sets of the truck 10. While this V-shaped configuration represents one example, it is contemplated that other configurations of the steering mechanism could also be employed, provided that the steering arms have a central articulation point 190 that allows the steering arm to connect with another steering arm in a manner consistent with the examples described herein. For instance, the steering arms may take on a C or U-shaped configuration.

The steering arms 110/130 have respective joining components 120/140 that facilitate the connection between the two arms of the steering mechanism 100. The joining components are situated at or about the vertex of each of the V-shaped steering arms, and arranged to face the opposing joining component of the opposing steering arm. An articulation mechanism 160, which can be, for example, a nut/bolt assembly, a clamp, or similar device, articulates or connects the two steering arms 110/130 at the connection point.

The first steering arm 110 includes two separate support arms 114 and 116 that form a V-shaped configuration that converges at a vertex 112. Each support arm 114/116 extends away from the vertex 112 at an angle, towards respective arm ends 115/117 at the first side 102 of the steering mechanism 100. Likewise, the second steering arm 130 includes two separate support arms 134 and 136 that form a V-shaped configuration that converges at a vertex 132. Each support arm 134/136 extends away from the vertex 132 at an angle, toward respective arm ends 135/137 at the second side 104 of the steering mechanism 100. As noted above, the arm ends 115/117 and 135/137 can be used as linkages that allow for brake beams to attach to the truck outboard of the wheel sets. FIG. 13 provides a photograph of such an outboard brake beam arrangement.

Figure 3:
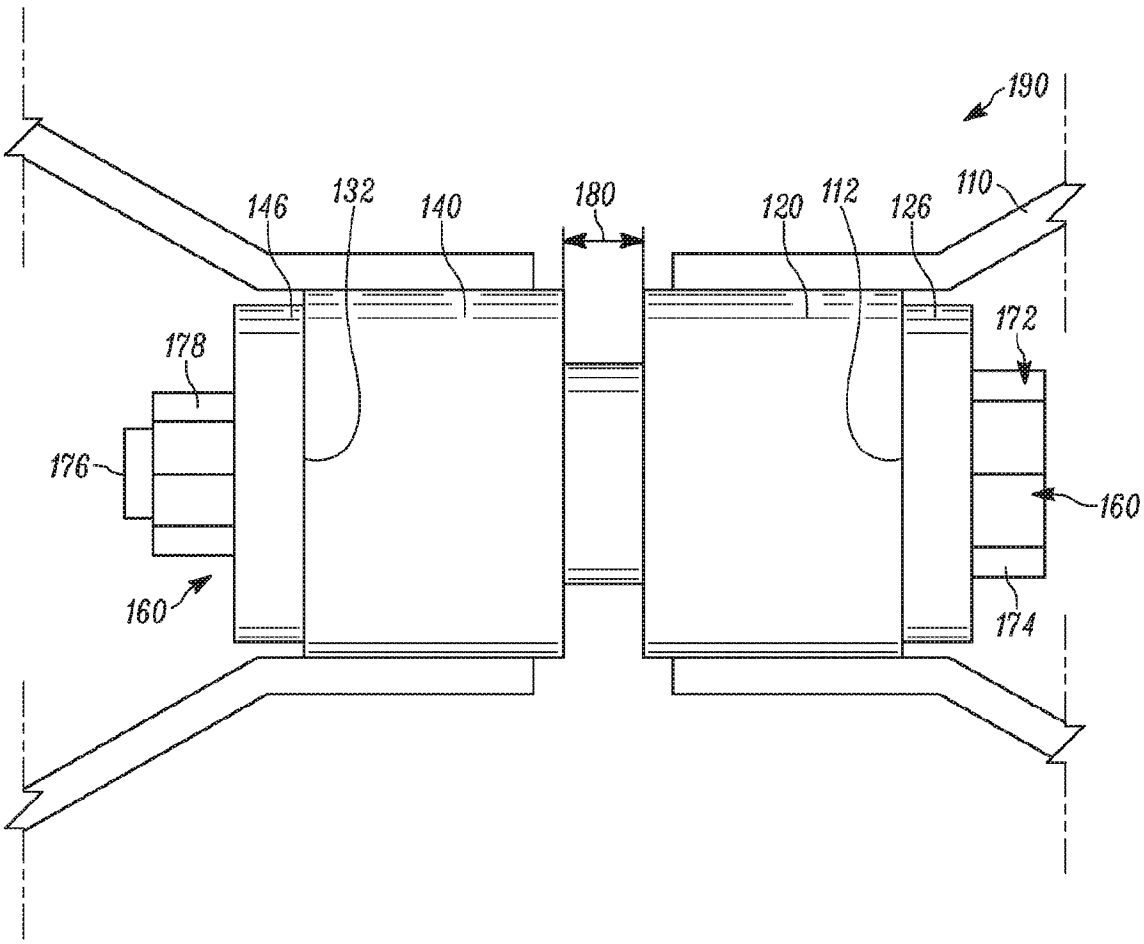
FIG. 3 is a close up top view of an articulation point where the two steering arms that form the steering mechanism of FIGS. 2A and 2B connect.

FIG. 3 is a close up view of an articulation point 190 where the two steering arms 110/130 of the steering mechanism 100 connect. As shown, the first joining component extends from the first vertex 112 away from the first side of the steering mechanism toward the second steering arm 130. Likewise, the second joining component 140 extends away from the second vertex 132 and faces the first joining component 120 of the first steering arm 110. The joining components 120/140 may include an aperture, which allows an articulating mechanism 160 to pass through, thereby clamping and/or linking the two steering arms together. The articulation mechanism 160 may include a nut and bolt assembly with a bolt 172 having a bolt head 174 that abuts against the first joining mechanism (or in some cases, against a cushion pad 126 of the joining component), and a shaft 176 that passes through both joining components 120/140, with a portion that extends beyond the second joining component 140. It should be noted that the opposite configuration, where the bolt head 174 abuts the second joining component 140 and the shaft 176 passes beyond the first joining component 120 is also a plausible configuration. Cushions or pads 126 and 146 can be positioned on opposite sides of both joining mechanisms 120/140, and can help provide for the flexibility of the steering mechanism 100. A clamping device 178, such as a nut, attaches to the bolt shaft 176 and applies a clamping force that holds the two steering arms together.

The joining components articulate the two steering arms in a manner that allows a separation space 180 between the two arms. This separation space 180 or clearance allows the two steering arms 110/130 of the steering mechanism to rotate relative to one another, thereby limiting rolling resistance when the truck passes along curved rail track. The separation 180 is configured to allow a controlled amount of rotation, but not so much that the steering mechanism becomes unstable such that the truck will wobble, vibrate, or face hunting issues that can inhibit the efficiency of the vehicle, particularly as it travels on straight track and/or at high speeds. For instance, the separation 180 can be sufficient to meet the hunting requirements of AAR Specification M-976 and Chapter 11 of the AAR Manual of Standards and Recommended Practices, which hunting requirements include that the truck be tested under an empty test car and that at 70 mph the lateral acceleration of the car is not to exceed 1.5 g's peak to peak with a maximum standard deviation of 0.13 (hereinafter "the AAR hunting requirements"). This separation 180 allows the steering arms to follow the geometry of the rail as the truck negotiates curved track. The separation can vary depending on the particular needs and designs of the steering mechanism 100 and the truck. In one example, the separation 180 may be less than about one inch. More particularly, the separation 180 may be between about ⅛ of an inch and ⅜ of an inch. Even more particularly, in some examples, the separation may be about ¼ of an inch. The separation is maintained by way of an insert that is positioned between the two joining components 120/140.

Figure 4:
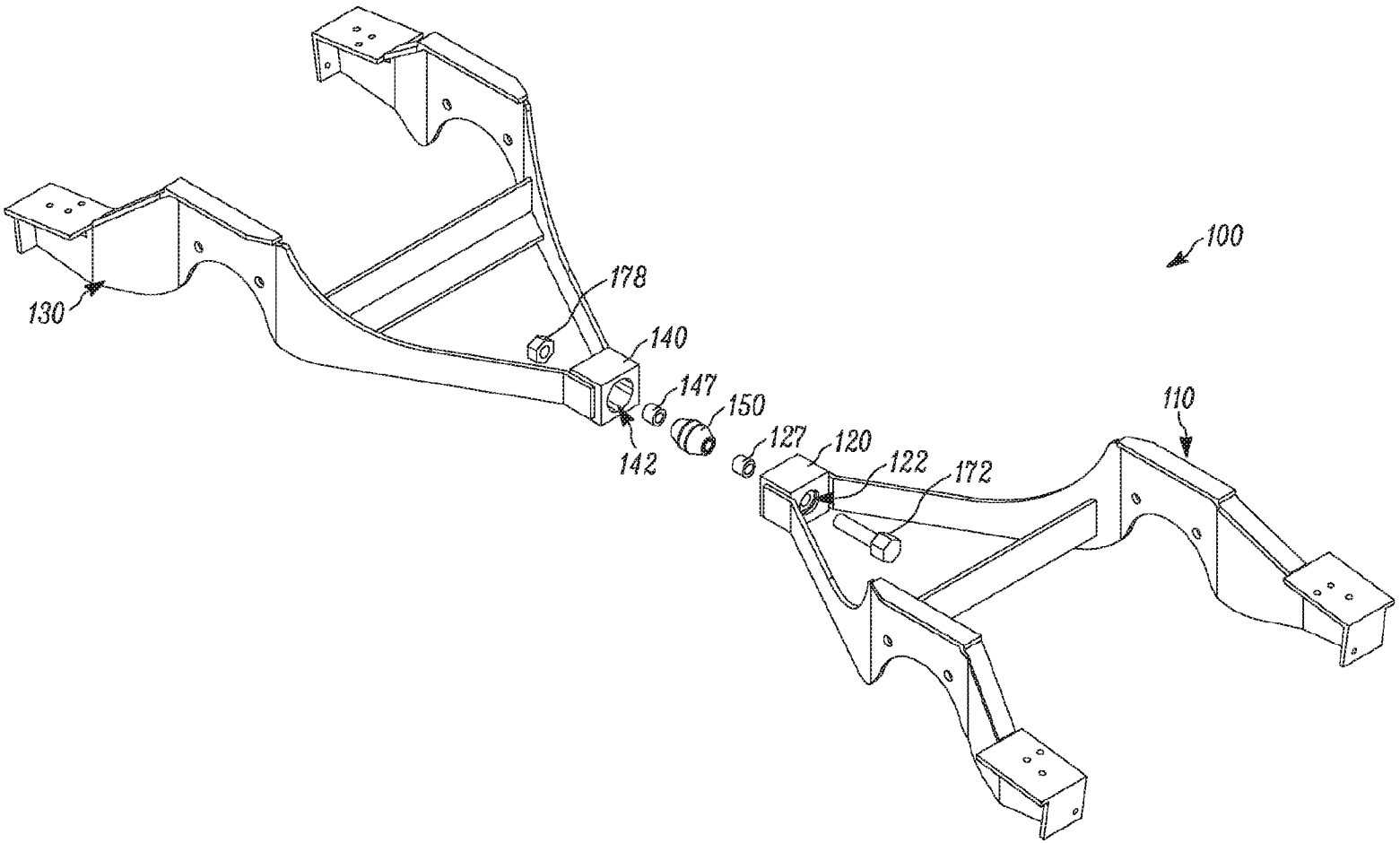
FIG. 4 is a blown-apart isometric view of the steering mechanism of FIGS. 2A and 2B.

FIG. 4 is a blown-apart view of the steering mechanism 100 that shows the internal components at the articulation point. As shown, the joining components 120/140, which have a box-like external appearance, each have respective recesses 122/142, which form cup-like female mating components. The insert 150 is configured to be positioned between the two joining components 120/140, and to fit within each of the recesses 122/142. The bolt 172 passes through an aperture in the first joining component, a center opening in the insert 150, and an opposite aperture in the second joining component, such that the nut 178 or other clamping mechanism can secure the two steering arms 110/130 together. Bushings or sleeves 127/147 are positioned between the joining components 120/140 and the insert 150, which help control the clamping pressure and the separation distance between the two steering arms 110 and 130, as discussed further below.

Figure 5C:
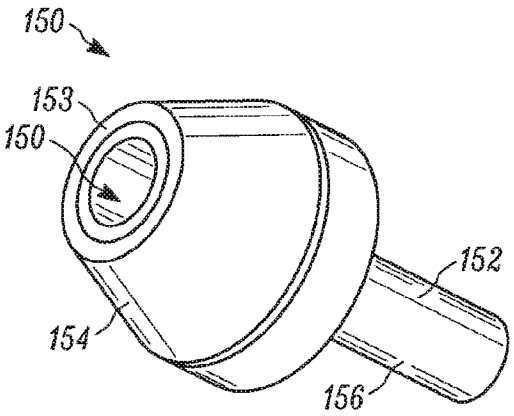
FIGS. 5A-5D show internal structure of an articulation point used in connection with the steering mechanism of FIGS. 2A and 2B.
Figure 5B:
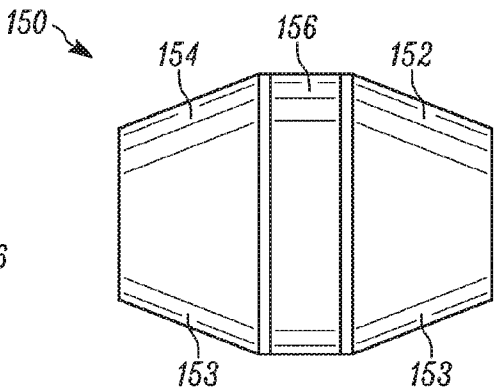
Figure 5A:
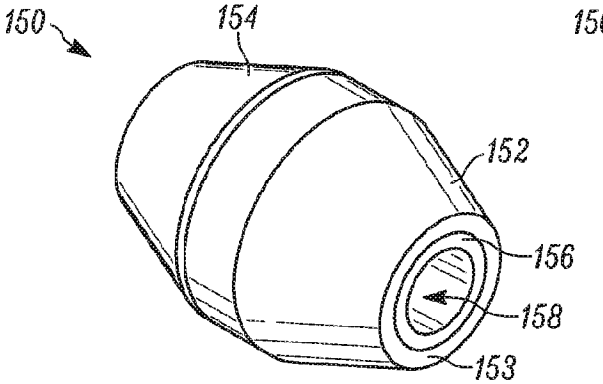

The insert is shown in more detail in FIGS. 5A-5C. FIG. 5A shows an isometric view of the insert 150, FIG. 5B shows a side view of the insert, and FIG. 5C shows another isometric view of the insert 150, with a portion of the insert removed to show internal detail of the insert 150. The insert 150 has a first side 152 and a second side 154, which are configured to be inserted or fit within the respective first recess 122 and second recess 142 of the joining components 120/140 of the steering arms 110/130. The shape of the insert in FIGS. 5A and 5B will be described as a "conical shape," as the shape uses at least some segments of a cone. More specifically, the first side 152 of the insert 150 has a truncated cone shape (with the tip of the cone lopped off), with the base of the cone facing the center of the insert 150. The opposing second side 154 of the insert mirrors that of the first side, and a cylindrical portion is situated there between. This shape allows for the two steering arms 110/130 of the steering mechanism 100 to have the desired control of motion about all six degrees of freedom.

While this conical shape is suitable in some situations, it is contemplated that variations on the shape may also be employed. For instance, the insert may have a spherical shape, or a 3-dimensional elliptical shape, such as a prolate spheroid (i.e., a football shape), an egg shape, or other shapes, provided that the insert is adapted to mate with the recesses of the joining components 120/140 of the steering arms 110/130. The insert 150 also includes a central opening 158, or a tunnel that is configured to receive the articulation mechanism 160 (e.g., a bolt or pin) that passes through the joining mechanisms.

The insert 150 includes a base 156, which can be formed from a rigid material, such as steel or other metals, and can take on a segmented cylindrical shape, as shown in FIG. 5C. The base material 156 provides stability to the insert 150, and therefore the articulation point 190 of the steering mechanism 100, and helps maintain the separation 180 at a relatively constant value. The insert 150 also includes a flexible material 153 surrounding the base material 156 on each side 152/154 of the insert 150. The flexible material 153 can be formed from an elastomeric material, such as rubber, for example. The flexible material 153 is generally more flexible (i.e., less stiff) than the base material, and provides the flexibility necessary to allow the steering arms 110/130 to rotate relative to one another. In other forms, the insert 150 could be formed without a rigid base, such that the entire insert 150, or at least a majority of the insert, is formed from a flexible or elastomeric material, such as rubber or another polymer.

The type and flexibility of the flexible material 153 can vary depending on the desired functionality of the steering mechanism 100. For example, where stiffer steering control is desired (e.g., where the steering mechanism is to be used on rail cars that will predominantly travel at high speeds on straight track), than a flexible material 153 can be selected to have stiffer properties. Conversely, where more flexible steering control is desired (e.g., where the steering mechanism is to be used on rail cars that intend to negotiate frequent or significant curves), a softer or more flexible material 153 can be selected. In this way, the flexible material 153 may be the only component of a truck that differs from truck to truck, while still providing adaptability that allows a truck manufacture to adapt a steering control level based on the intended use.

Figure 5E:
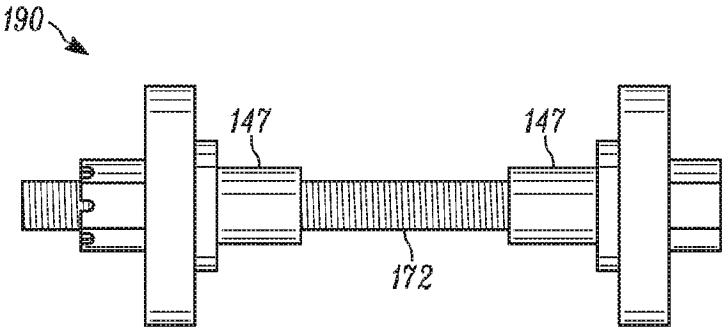
FIG. 5E shows the side view of FIG. 5D with the insert removed.
Figure 5D:
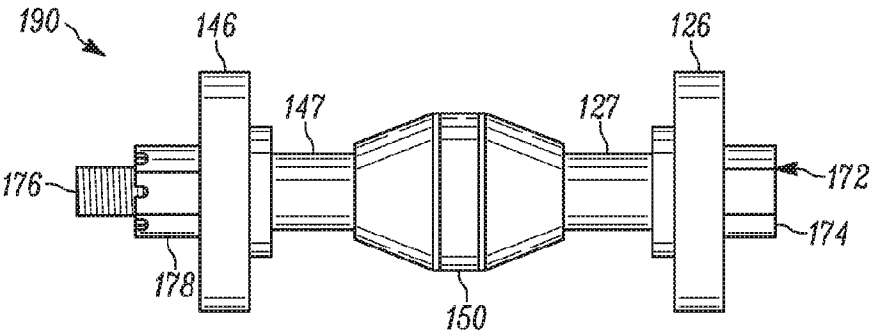

FIGS. 5D and E shows the internal structure at the articulation point 190 adjoining the steering arms of the steering mechanism. The articulation point 190 includes the insert 150, and a bolt 172 that passes through the central opening 158 of the insert 150. The bolt has a bolt head 174 that compresses against a cushion 126 associated with the joining component of the first steering arm. Generally speaking, the cushion 126 is exterior to the joining component of the first steering arm, such that the cushion 126 abuts against an exterior surface of the joining component. On the opposite side of the insert, a portion of the shaft 176 of the bolt 172 extends beyond the joining component of the second steering arm, such that a clamping mechanism 178, such as a nut, can apply a clamping force to the articulation point 190. The second side of the articulation point 190 also includes a cushion 146, which the clamping mechanism 178 compresses against. On each side of the insert 150 are two spacers 127/147, which can be bushings or sleeves. The spacers 127/147 form a solid column through the center of the center connection. The spacers can be formed from a rigid material, such as steel or another metal. As shown in FIG. 5E, the spacers 127/147 have an opening that is wide enough to receive the bolt 172 that passes through the insert 150. In some situations, the spacers 127/147 can be used to at least partially control the clamping force on the articulation point 190. That is, as the clamping mechanism 178 is tightened (e.g., by turning the nut), the movement of the clamping mechanism is impeded when the clamping mechanism and/or the joining components of the steering arms contact or encounter the rigid column of the sleeves 127/147. This contact sets the clamping force of the elastomers, and also controls the separation distance 180 between the two steering arms. Utilizing sleeves 127/147 in this manner alleviates the need to control, or establish a predefined torque value on the articulation mechanism or nut/bolt assembly. However, in alternative embodiments, the clamping force and/or the separation distance 180 between the steering arms can be controlled using a predefined torque value, such as by using a torque wrench, or by using a gauge block to control the separation distance.

Figure 6:
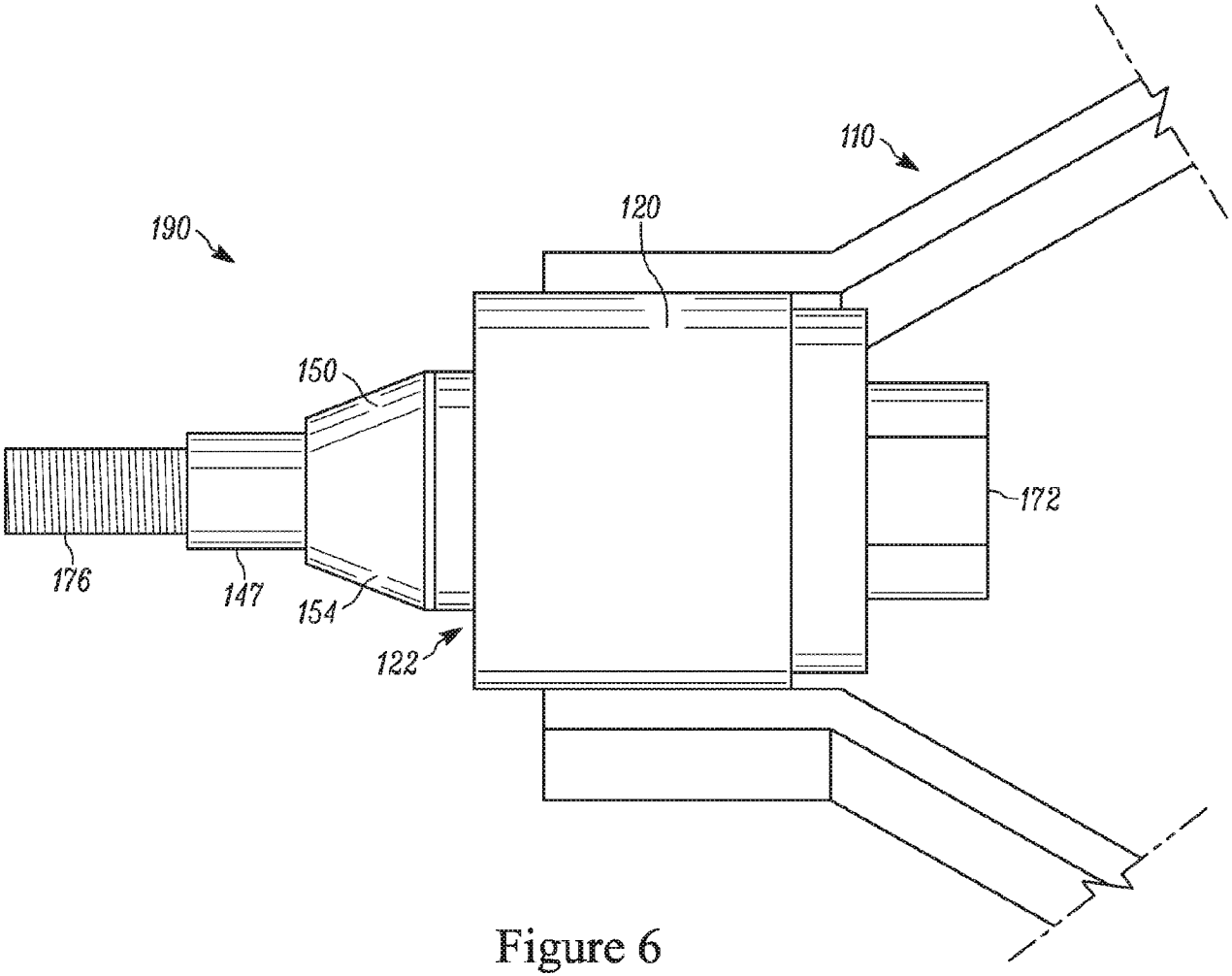
FIG. 6 shows the articulation point of FIG. 3, with a second steering arm removed to show internal structure.

FIG. 6 shows a close up view of the articulation point 190 of the steering mechanism 100, but with the second steering arm 120 removed from view. As shown, the first side (not visible in this Figure) of the insert 150 is placed within the recess 122 of the first joining component 120. The second side 154 of the insert 150 is similarly able to be inserted into a recess on an opposing joining component. The bolt 172 also passes through the joining component 120, the insert 150, and the second sleeve 147 (the first sleeve 127 being hidden by the first joining component 120), such that a portion of the bolt shaft 176 can be clamped or otherwise secured at the other end of the connection.

Because the material on the first and second sides of the insert 150 is flexible, the insert will be able to deflect in response to a rotational force or moment being applied about the articulation point 190. The amount of deflection will depend, at least in part, on the stiffness/flexibility of the material. Depending on the amount of rotation that is desired, the material of the insert 150 can be selected to be more rigid or more flexible. In some situations, the insert is selected to have a flexibility level that is sufficiently stiff to inhibit hunting of a rail car truck traveling along a straight track, while at the same time being sufficiently flexible to inhibit rolling resistance of a rail car truck negotiating turns For example, the flexibility of the insert 150 can be sufficient to meet the AAR hunting requirements, while at the same time having a rolling resistance of 200 pounds or less, and in some cases 100 pounds or less, for up to 12 degrees of curvature.

It should be noted that the present Figures describe an embodiment that uses a removable insert to facilitate the connection, and in some situations the insert may be an extension of one of the steering arms. For example, the joining component of one steering arm may include a male mating component, such as a nose or extender protruding from the joining component as a male connector, which connector may take on a shape and configuration similar to one side of the insert 150. That is, the male connector may have a conical shape and comprise a flexible material. The joining component of the opposing steering arm may include a corresponding female mating component, such as a recess similar to those described with respect to the Figures. In such a situation, the steering arms can connect in a similar fashion to that described with respect to FIGS. 1A-6, such that the male component of one steering arm inserts into the female component of the second steering arm. The significant difference between such an embodiment and those that use the insert 150 is that the steering arms comprising the male connector would not be adaptable to use separate connectors. Accordingly, the stiffness of a steering mechanism employing such a male-connector-steering arm would not be readily adaptable without being able to replace the flexible material on the male connector.

Figure 7:
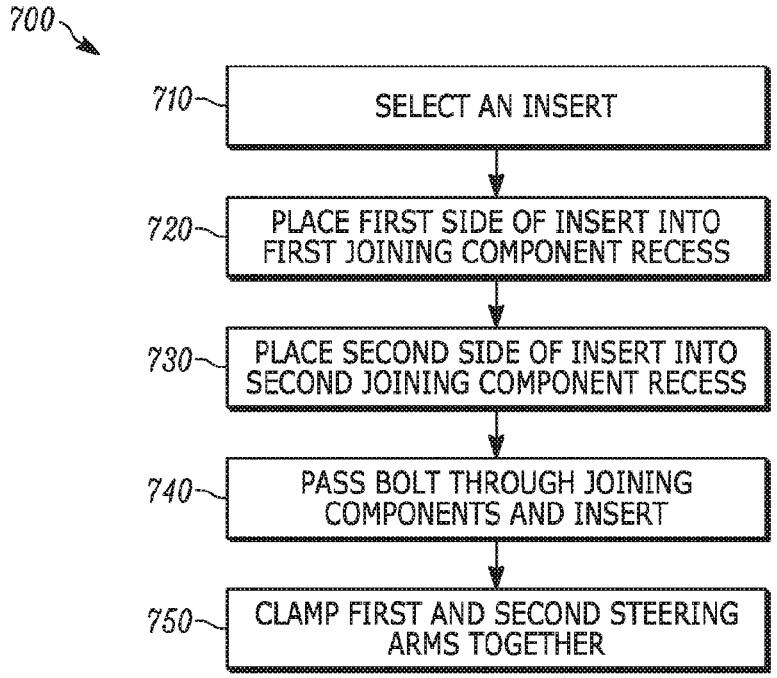
FIG. 7 is a flow diagram of a method used in accordance with examples described in this application.
Figure 8:
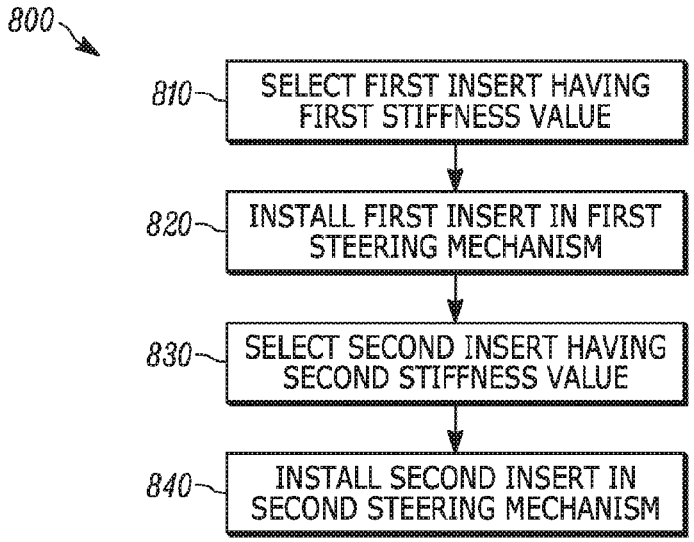
FIG. 8 is a flow diagram of another method used in accordance with examples described in this application.

The present application also presents methods for assembling a steering arm assembly for a rail car. FIG. 7 is a flow diagram of a method 700 used in accordance with examples described in this application. The method may involve manufacturing and assembling steering mechanisms such as steering mechanism 100 shown in FIGS. 1A-6 and described above, but it may also relate to methods of assembling steering mechanisms that take on variations or different formats. For example, the steering mechanism can have the same V-shaped configuration as shown in the Figures, or it may have alternative configurations, such as a C-shape or a U-shape, provided the methods of assembly remain consistent.

The method 700 includes selecting 710 an insert having a conical shape. As described herein, a "conical" shape means that the insert has segments that form portions of cones or conical structures. For instance, the insert may take on the shapes of the insert 150 shown in FIG. 5. However, the insert may also take on other shapes, such as spheres, spheroids, or egg shapes, provided that the insert is adapted to mate with the joining mechanisms of the steering arms, as described below. The selected insert will have a shape that is configured to mate with corresponding components on steering arms that form the steering mechanism. For instance, the insert can have a first side with a shape that corresponds with a recess on a joining component of a first steering arm, and the opposite side of the insert can have a shape that corresponds with a recess on a joining component of a second steering arm. In some instances, the two sides of the insert may be identical (or essentially identical) such that the insert is symmetrical. However, in some instances it may be useful to select an insert that is not symmetrical, such that each side of the insert is configured to mate with a different mating component on a different steering arm. Consistent with the embodiments described with respect to FIGS. 1A-6, the insert can have a base formed from a rigid material, and a flexible material (e.g., rubber) extending from the base, such that at least a portion of the insert that mates with or contacts the steering arms is somewhat flexible. The flexible material can be bonded to the base. Different inserts may utilize different flexible materials depending on the intended use of the steering mechanism. For example, where the steering mechanism is designed to be used on straight tracks, the selected insert may utilize a flexible material that is significantly stiffer than that of another insert. Alternatively, where the steering mechanism is designed to be used on rail cars that will frequently negotiate tight turns, then the selected insert may include a flexible material that is significantly more elastic or flexible than other inserts. In some aspects, the selected insert also has a central through opening, for example, to receive a pin structure, such as a bolt.

The selected insert is then mated with a corresponding mating component on a first steering arm. This mating 720 can involve placing the first side of the insert into a recess on a joining component of a first steering arm. The steering arm may include a pair of support arms arranged in a V-shaped configuration extending away from the joining component, such as the steering arms 110 and 130 described herein.

The selected insert also mates with a corresponding mating structure on a second steering arm. For example, the mating 740 may include placing the second side of the insert into a recess on a joining component of the second steering arm. The second steering arm may be identical to the first steering arm, or it can take on a different structure, depending on the structure of the rail truck that the steering mechanism will be used on.

Next, the two joining components of the steering mechanism are articulated together. The articulation can involve passing a bolt 740 through the first and second joining components so the bolt passing through a central opening in the insert, so that a head of the bolt abuts one of the joining components and so that a portion of the bolt extends beyond the other of the joining components, and subsequently applying 750 a clamping component to the portion of the bolt that extends beyond the other of the joining components to clamp the first and second steering arms together. In other examples, the clamping can take on other forms, and may involve other equipment different from a nut and bolt assembly.

Upon performing the clamping, the first and second joining components will be separated by a minimum distance by way of the insert. That is, the insert (and the corresponding mating structures of the steering arms) will be configured so that, when fully clamped, the insert maintains a separation between the two steering arms. This separation allows the first and second steering arms to rotate relative to one another, such that the rotation will not be thwarted or obstructed by way of contact with an opposing steering arm. This rotation can be a yaw rotation, that is, a rotation in a plane parallel to the steering mechanism (i.e., a plane parallel to the tracks on which the rail car truck will travel). However, the assembled steering mechanism can be configured to control motion and rotation among all six degrees of freedom, via the insert and the use of other articulation devices. The insert is configured to provide resistance to the relative rotation between the first and second steering arm, and the flexibility of the insert, namely the flexible material that is part of the insert, will at least partly affect the ability of the insert to resist the rotation. As such, selecting a particular insert will allow a manufacturer to control, at least partially, the stiffness of the steering mechanism. In some examples, the method 700 can also include further installing the assembled steering mechanism to a rail car truck. For example, the installing can include connecting each of the support arms of the individual steering arms to a roller bearing adapter associated with a wheel set of the rail car truck.

The method 700 can be repeatable for the assembly of multiple steering mechanisms, such that different steering mechanisms can be produced using the same, or essentially the same process, with the only difference being which insert is selected. By selecting different inserts, manufacturers can easily produce steering mechanisms having different stiffness properties without having to overhaul, or even significantly modify any major aspect of the assembly or manufacturing process. In one particular example, shown in FIG. 8, a method 800 of assembling multiple steering mechanisms can include assembling a first steering mechanism. The assembly of the first steering mechanism can include selecting 810 a first insert (such as any of the inserts described herein) with a shape that is configured to mate with recesses on joining components of each of a first and second steering arm. The first insert comprising a base and a first flexible material extending from the base, the first flexible material providing a stiffness value of the first insert. The selected insert is then installed 820 in the first steering mechanism. The installing 820 can include inserting the first insert into the recesses on the joining components of the first and second steering arms, and articulating the joining components of the first and second steering arms with an articulation or clamping device (e.g., a nut and bolt assembly). The method 800 also includes assembling a second steering mechanism that has a different steering stiffness from the first steering mechanism. The assembling includes selecting 830 a second insert having a shape that is configured to mate with recesses on joining components of each of a third and fourth steering arm, where the third and fourth steering arms are identical, or essentially identical to the first and second steering arms, respectively. The second insert comprising a base and a second flexible material that provides a stiffness value of the second insert. The second insert can be identical, or essentially identical, to the first insert in all aspects other than the flexible material and stiffness properties thereof. The second selected insert is then installed 840 in the second steering mechanism, which installing 840 can include inserting the second insert into the recesses on the joining components of the third and fourth steering arms, and articulating the third and fourth steering arms together. In essence, steps 820 and 840 of the method can be identical, or virtually identical, with the only significant difference being the type of insert that is used. More specifically, the only difference can relate to the particular stiffness value of the insert that is used, which can result in two different steering mechanisms that are designed for two different purposes. This can still be accomplished without substantially modifying the manufacturing or assembly process.

Various aspects, features, and examples of steering mechanism, and in particular, of a connection or articulation point for a multi-arm steering mechanism, have been described. Such steering arms offer tangible benefits and improvements when implemented on rail car trucks. For example, the steering mechanisms can cause the wheel sets of a truck to assume a radial position (or close thereto) while a rail car is negotiating a curve or turn. By arranging the wheel sets in a radial position, the steering arm thus helps avoid or inhibit detrimental forces that can otherwise arise between the wheel flanges and the rail in the curve. This can reduce wear on both the wheel and rail, thus providing significant benefits to both the owner of the rail car that is responsible for maintenance of the wheels, and the owner of the railroad track itself. Moreover, the steering mechanism also helps reduce resistance to trains traveling around curves. Curving resistance testing was conducted at the TTCI during testing, and the test results showed that the curving resistance of the ATS truck employing steering mechanisms in accordance with the above disclosure was much lower than the common three-piece truck in service on many freight cars operating in interchange service in North America. The results of such testing is shown in FIG. 9 (and discussed in more detail below).

Another benefit of the steering mechanism is that it helps to square off the two wheel sets while the truck is negotiating a straight or tangent track. That is, the steering mechanism helps assure that the wheel sets of a truck are essentially parallel when the track itself is straight. Squaring the wheel sets helps inhibit track hunting, thereby improving the performance of the rail car at high speeds. It also inhibits lateral oscillations among the wheel sets, which improves performance under the normal speeds of operation.

The steering mechanism described herein can be formed from fabricated steering arms, which allows for a lighter weight construction. The weight of the ATS steering mechanism can be formed to be 400 pounds or less, which is lighter than other steering mechanisms. In some forms, the weight of the entire steering mechanism can be formed to be 200 pounds or less. In some forms, the outer ends of the V-shaped steering arms can be bolted directly to the roller bearing adapters of the truck. This direct connection to the adapters, which thereby forms a direct connection to the wheel sets, allows the steering mechanism to directly control the geometry of the two wheel sets relative to each other. For instance, if the lead wheel set of the truck enters a curve and rotates or takes on an angle of yaw relative to the truck side frames and the freight car body, the trailing wheel set will rotate in an opposed yawing movement. The exact amount of rotation or yawing is generated by the wheel rail geometry and the stiffness of the insert installed between the two steering arms. It has been found from testing at the TTCI that the ATS steering mechanism described herein results in significantly reduced rolling resistance compared to other current trucks operating in the North American Interchange System.

Figure 9:
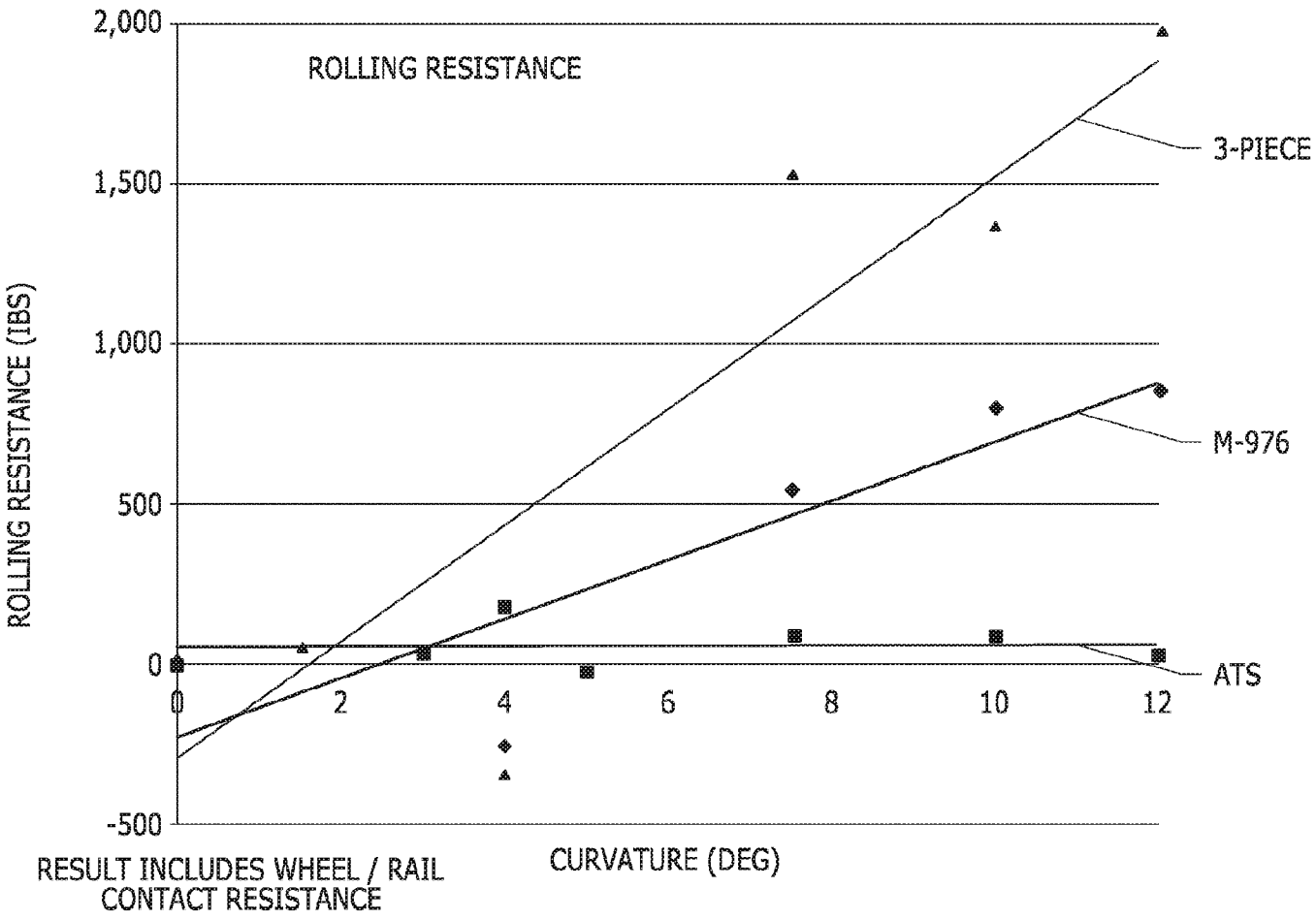
FIG. 9 is a graph depicting comparative results relating to the rolling resistance on a variety of truck assemblies as those truck assemblies travel along curved rails.

FIG. 9 is a graph showing the results of this testing. Specifically, FIG. 9 is a graph depicting comparative results relating to the rolling resistance of the ATS truck (which uses a steering mechanism in accordance with the present disclosure) compared to a variety of truck assemblies, including a 3-piece truck and an M-976 truck, as those truck assemblies travel along curved rails. The rolling resistance testing was conducted by placing a test car with the particular trucks under test (e.g., ATS, 3-piece, M-976) supporting each end of the car into a train including multiple freight cars. A special load cell connection was placed between the test car and a preceding car, which load cell was capable of measuring the force required to pull and push the test car through curves of various degrees of curvature on the Wheel Rail Mechanism Loop at the Transportation Technology center.

In FIG. 9, the value of rolling resistance is given in pounds along the vertical axis and the curvature of the rail is given in degrees along the horizontal axis. A curvature of zero degrees represents straight or tangent track. Therefore, as the degree of curvature increases, the curve in the track becomes "tighter," which generally requires more force to pull a rail car through the curve. As can be seen from FIG. 9, however, there was no increase in rolling resistance for the ATS truck in curves up to 12 degrees of curvature, which 12-degree curve represents an extreme curve for mainline rail track. The rolling resistance of a 3-piece truck increases dramatically relative to that of the ATS truck as the degree of curvature increases, and reaches a maximum value of about 2,000 lb. at 12 degrees. The rolling resistance for an M-976 truck, which is another version of the 3-piece truck, also increases significantly relative to that of the ATS truck as the degree of curvature increases.

Figure 10:
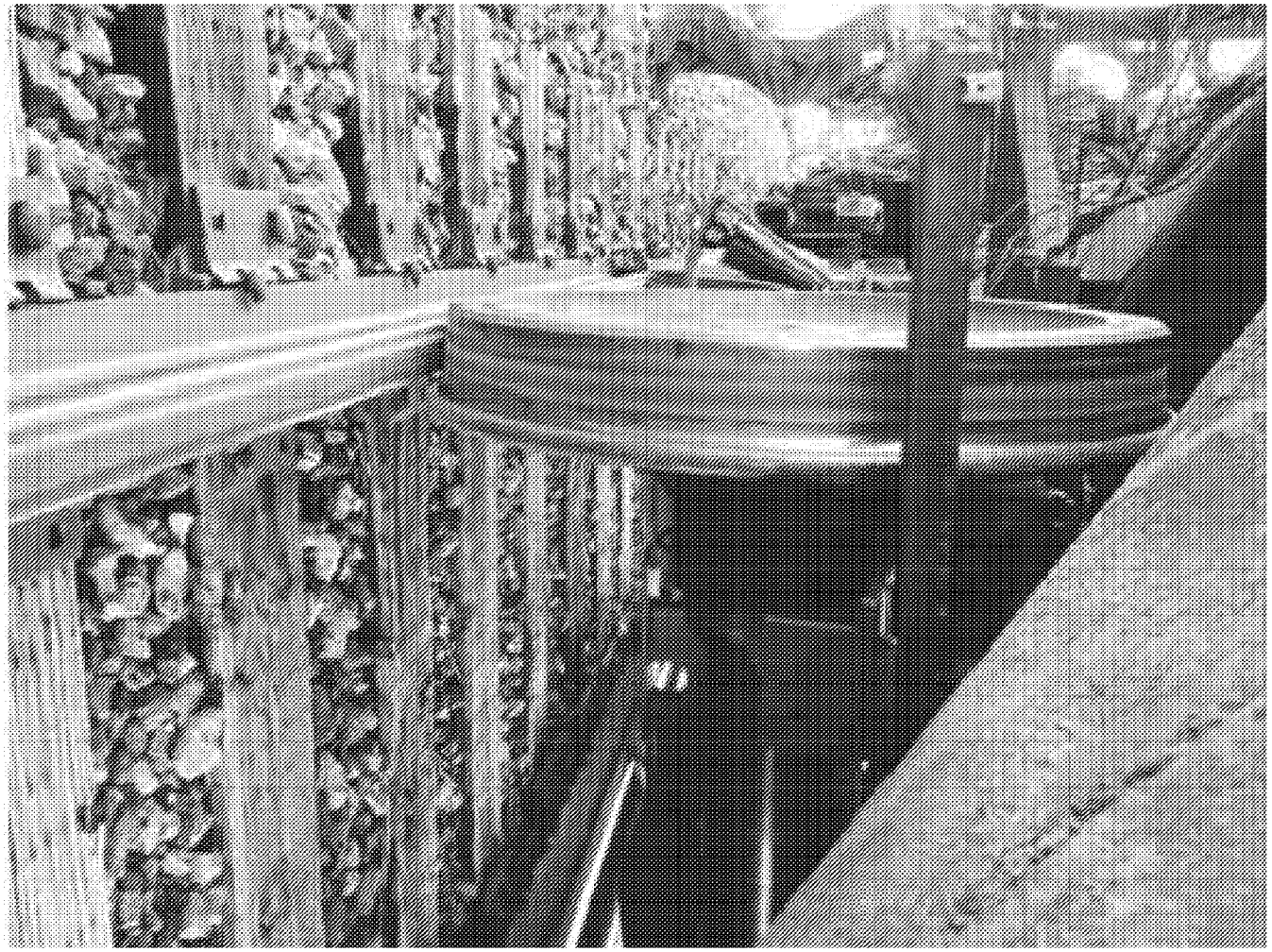
FIG. 10 is a photograph showing the rail contact mark on a wheel after testing, wherein the wheel was used on a truck that used a steering mechanism in accordance with the present disclosure.

Another observation made during the rolling resistance testing was that a rail contact mark or ring on the tread of the wheels on the ATS trucks was centered on the tread over a band of about 1 to 1½ inches wide. This is shown on the wheel depicted in the photograph of FIG. 10. This indicates that the ATS steering mechanism allowed the truck to negotiate the various curves on the test track while keeping the wheels centered on the rail, thereby inhibiting the wheel flanges from contacting the rails and resulting in lower rolling resistance. Other trucks tested to demonstrated that the wheel flange would more frequently contact with rail, thereby causing (at least in part) the higher rolling resistance.

Because the steering mechanism employs an insert that inserts into both steering arms, the steering mechanism is able to maintain a relatively straight alignment among the wheel sets during operation on a straight track. This is due, in part, to the rigidity of the steering mechanism, and its ability to span between, and enter into the respective steering arms. This configuration establishes a link that inhibits unwanted sway on a straight track. However, because the insert also comprises flexible material on the portion that inserts in to the recesses of the steering arms, when a rotational moment or force is applied to the insert (e.g., when the truck travels along a curve), the flexibility of the material allows some leniency, and thus allows the steering arms to momentarily rotate relative to each other so that the wheel sets can remain essentially parallel with the rail tracks. In some situations, this ability to allow rotation can also be facilitated, at least in part, by the shapes of the insert and recesses of the joining components. For instance, utilizing a conical shaped insert and corresponding shape for the inserts allows relatively even freedom of rotation about the connection point.

Another capability of the ATS Steering Truck concerns the ability to tune the truck for different operating conditions. Because, at least in some examples, the insert is a separate component from the steering arms—that is, it is removable from the steering arms because it is not an extension there to, the steering arms can be adaptably assembled to cover a variety of different stiffness values and to meet a variety of different steering objectives. In other words, a steering arm manufacturer can make different steering mechanisms, on demand, that have different stiffness values without having to significantly alter the manufacturing process and without having to obtain different steering mechanism components (aside from the different inserts). The properties flexible material (e.g., a polymer piece) in the central connection between the two steering arms can be optimized, for example, using a dynamic numerical analysis. In this way, users of the ATS steering mechanism may be able to fine tune the steering stiffness to achieve particular performance characteristics when one regime of performance is emphasized over another based on a particular numerical analysis. Therefore, the ATS Steering Truck includes the potential to tune the truck for specific service conditions.

Figure 11B:
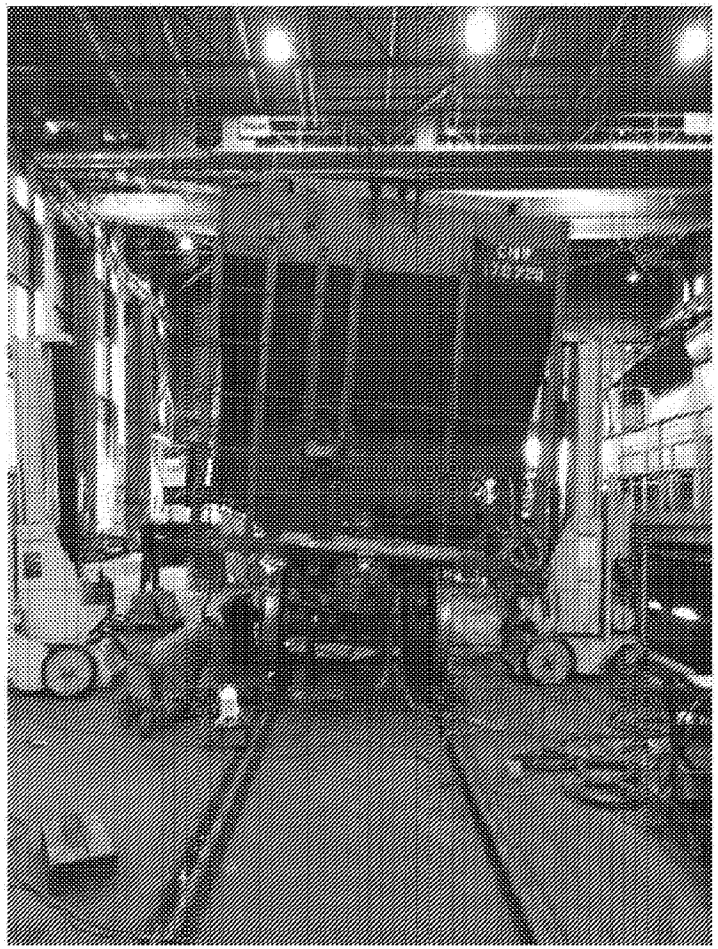
FIGS. 11A and B are photographs demonstrating the performance of tests on rail car trucks in accordance with examples described herein.
Figure 11A:
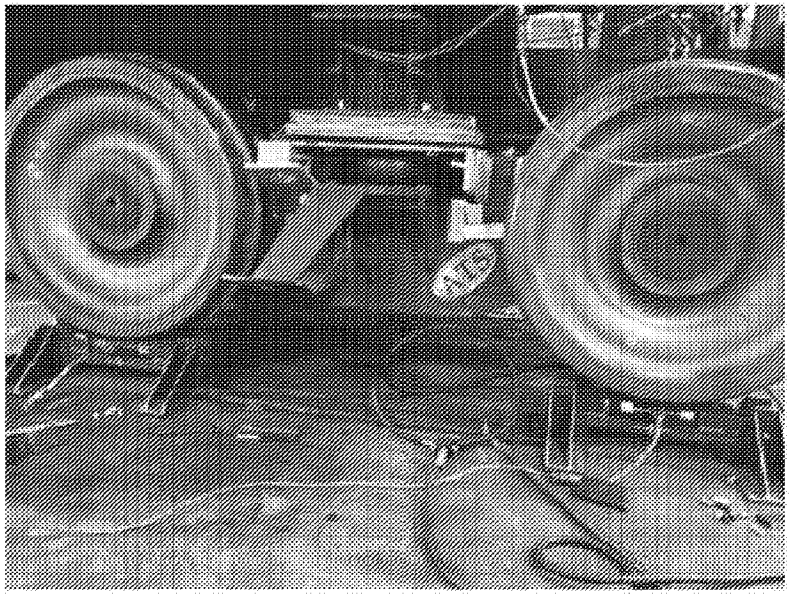

Yet another benefit of the presently described steering arms relates to the ability of the truck to distribute load as a result of the conical shape of the connection between the steering arms (whether the connection is formed with an insert and two female connectors or with a male/female connector relationship). The conical shape of the central connection also allows for motion of the wheel sets where one wheel may be raised or lowered without unduly causing a detrimental reduction in vertical wheel load on any of the other wheels. Tests were conducted at the Transportation Technology Center where this capability was explicitly determined. FIG. 11A is a photograph showing ATS trucks installed under a fully loaded covered hopper car and placed on special instrumented beams that can accurately record the vertical force at each wheel. Wheels were then raised and lowered while recording the vertical forces on the eight wheels of both trucks. FIG. 11B shows the test car raised on one side tipping the car significantly.

Figure 12:
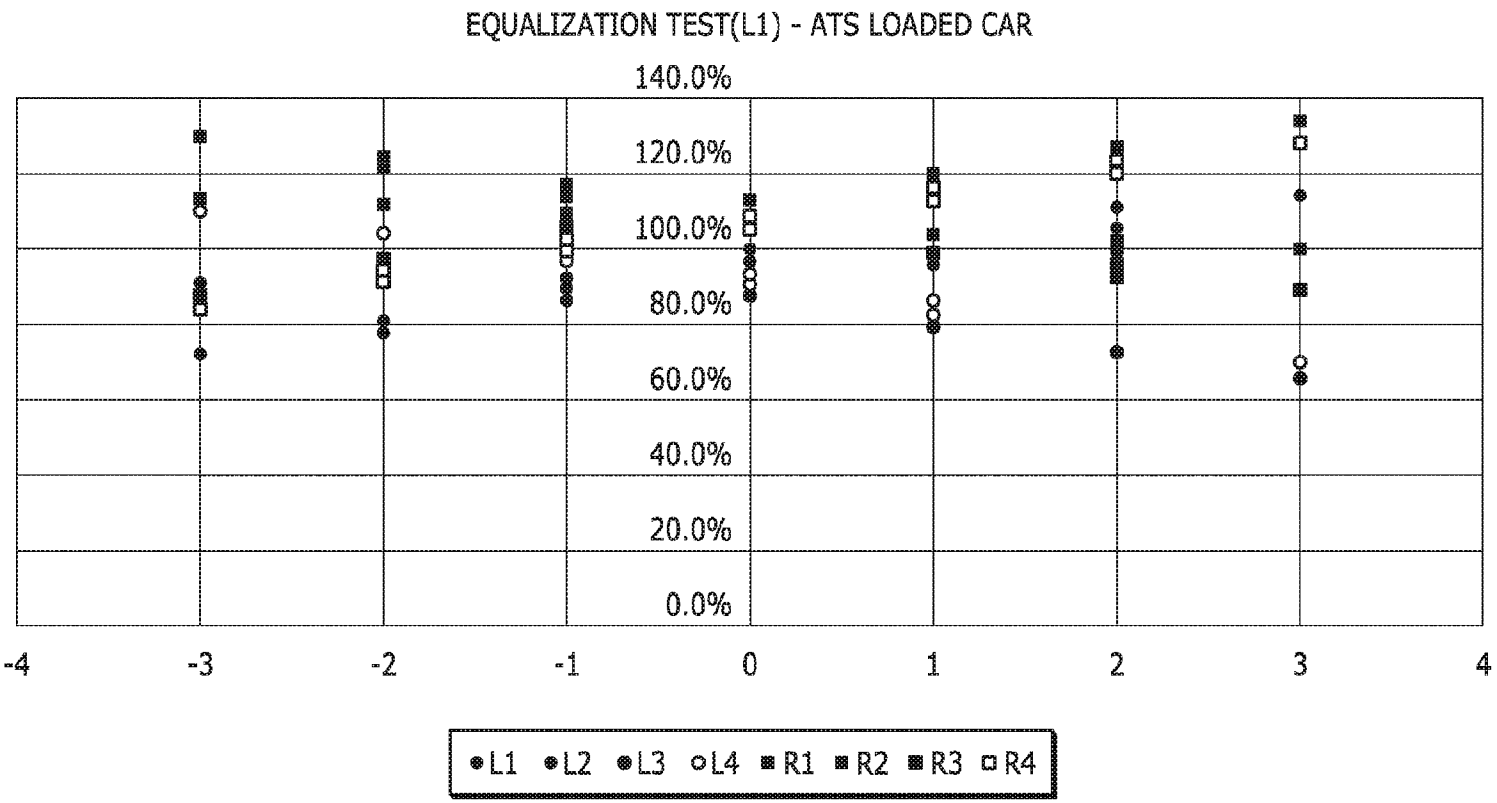
FIG. 12 is a graph plotting test results of an equalization test performed on a rail car using a steering mechanism in accordance with the present disclosure.

The results of raising and lowering one wheel, the L1 wheel, is shown in FIG. 12. The L1 wheel is the wheel shown on the left side of the car in FIG. 11B. The test began with the freight car level represented by the vertical axis at 0. At this point, there is not an equal distribution of vertical load on each wheel. As the L1 wheel is lowered, the associated data points going to the left or negative values along the horizontal axis, the vertical loads on the other seven wheels begin to change. The vertical loads on the R1 wheel, the wheel on the other end of the axle from the L1 wheel, is shown to change the most. However, as the L1 wheel is raised, more vertical load is transferred to the R3 wheel which is at the opposite end of the freight car. This is due to the very stiff construction of the freight car. The L3 wheel experiences the most reduction in vertical load during this test. Note, however, that at no time does any wheel experience a vertical load reduction less than 60% of what it was when the freight car was at the level position. This is considered to be very good results indicating that the ATS Truck with its Steering Mechanism can negotiate other than optimum track conditions.

Another benefit of some of the described steering mechanism examples is that the brake beams are attached through a linkage at the ends of the V-shaped steering arms such that the brake beams are located outboard of the wheels relative to the center of the truck. Each brake beam has a brake head at each lateral end that has a brake shoe engaged to it during normal operation. Because the steering arms move in alignment with the wheel sets, the brake beams and brake shoes are kept in alignment with the wheel treads. Brake beams on the standard 3-piece truck are located inboard of the wheels and are supported by cast in pockets on the side frames. Because the side frames of a standard 3-piece truck do not move in alignment with the wheel sets, the brake beams shift sideways relative to the wheel treads during operation. Also, the connection between the brake beams of the ATS truck can employ a tension connection, which can help keep the brake shoes aligned with the wheel sets. The connection between the brake beams of a standard 3-piece truck is utilizes compression members (as opposed to tension), which forces the brake beams laterally relative to the wheel sets. The lateral movement of brake beams on a standard 3-piece truck results in an asymmetric wheel wear condition as the brake shoes contact the wheel flanges of diagonally opposite wheels. This asymmetric wheel wear can be inhibited by the brake beam arrangement described above for the ATS truck. FIG. 13 is a photograph of a truck that employs such a brake beams arrangement (though brake shoes are not shown applied to the brake heads).

The ATS Truck

In addition to the steering assembly, the ATS truck includes a variety of other features, components, and modes of operation. Certain examples of such features will now be described. It should be understood, however, that these specific examples should not be considered to limit the scope of the present disclosure, or any of the other examples described in this application.

In one example, the ATS truck includes freight car truck with two wheel sets, each consisting of axles, wheels, and roller bearings within pedestals of two side frames of the truck. The wheels can be spaced on the axles 53 inches apart, from inside to inside, such that they can operate on standard gauge rails at the common dimension of 4 ft. 8½ inches. from gauge face to gauge face. The side frames can be located inboard of the wheels and include pedestals at the ends in which a roller bearing adapter is placed which sits on top of the roller bearing seat on the axle. The side frame pedestals are located longitudinally from each other to maintain a nominal axle/wheel spacing of about 70 inches. This spacing can vary by simply changing that dimension on the side frame, in particular, with this spacing can be changed relatively easily where the components are formed via a fabrication process. The ATS truck includes an elastomeric sandwich pad between the bearing adapter and the side frame, which pad can have specific properties in the longitudinal and lateral directions configured so that some rotation of the axles and wheels is allowed relative to the side frames. The ATS truck also includes a truck bolster above the side frames and is supported by a secondary spring made of an elastomeric material. The bolster is attached to the side frames by two hydraulic dampers located at an angle configured to react both vertical and lateral loads. The two hydraulic dampers are also located at diagonally opposite corners of the bolster and side frame assembly. A steering arm assembly, separate from the vertical load bearing assembly just described, is connected to four roller bearing adapters of the truck using a bolted attachment. The steering arm assemblies are made up of two similar subassemblies that are attached together by a centrally located bolted arrangement. The bolted arrangement includes elastomeric components of with characteristics configured to improve the curving performance of the ATS truck while at the same time maintaining parallel alignment of the two wheel sets when negotiating tangent or straight track at high speed thus providing a sufficiently high hunting threshold speed as to provide superior hunting performance.

In some embodiments, freight car truck includes a vertical load adapter attached to the body bolster of a freight car body. The attachment is located about 25 inches laterally from the longitudinal centerline of the freight car, one attachment on each side of the car. The attachment can be bolted or welded to the body bolster. If it is bolted, the attachment can make use of the standard holes in the body bolster used for attaching a body side bearing wear plate and associated shims. The vertical load adapter includes a series of plates one located on top of the other. The bottom plate has a length essentially parallel to the longitudinal centerline of the freight car body. The length and width of the bottom plate are sufficient so as to cover the entire surface of the nonmetallic plate located on top of the ATS bolster. The edges of the bottom plate are contoured slightly so as to avoid scrapping the surface of the nonmetallic plate as the truck bolster rotates relative to the freight car body bolster. If a bolted attached is utilized, the bolt holes in the bottom plate are countersunk so that the head of the bolt shall be below the bottom surface of the bottom plate to avoid gouging the nonmetallic plate when the truck bolster rotates relative to the body bolster. A filling material may be used to make the finished surface above the head of the bolt smooth in its interface with the nonmetallic plate. The intermediate plates, of which there may be one or several, make up the vertical load adapter and have sufficient thickness to level the car body at their four locations while also providing an interface between the central ring of the truck bolster and the centerplate of the car body, with a clearance of about ¼ inch between the top of the central ring and the horizontal flange of the body centerplate or body centersill. The length and width of the intermediate plates may be less than the length and width of the bottom plate. The material for the plates of the vertical load adapter shall be made of a grade of steel that can support the vertical load of a fully loaded freight car body of at least 286,000 pounds, less the weight of the ATS trucks.

In some examples, the truck bolster of the ATS truck is of a lightweight design compared to a standard three-piece truck because no vertical load is carried at the central location where the truck bolster interfaces with the centerplate of the freight car body. The truck bolster can include a ring at its center having a diameter large enough to allow a body centerplate, with a diameter of 14 to 16 inches to be inserted without interference. The central ring has a clearance around its circumference with the body centerplate of approximately ¼ inch. The vertical surface of said central ring is high enough to engage the vertical surface of the body centerplate or about 1¾ inches. The truck bolster at this central ring interface may carry no vertical load. The bolster may also include a center pin assembly located within and below the central ring. The center pin can have a height and diameter that can be inserted in the central hole of the body centerplate when the car body is lowered onto the ATS truck. The center pin assembly can work as a guide for lowering the car body onto the truck and may not react any vertical, longitudinal, or lateral loads. The truck bolster may also include two nonmetallic plates located such that their longitudinal centerlines lie within 2 inches (plus or minus) of the 25 inch dimension of the side bearing location on a freight car. The nonmetallic plates can be attached to the top of the truck bolster via a variety of means, including bolted, bonded, or even loose in a sufficient frame. The length and width of the nonmetallic plates is such that as the truck bolster rotates up to 12 degrees relative to the body bolster of the freight car, the bottom plate of the vertical load adapter maintains a contact surface with the nonmetallic plate of at least 70% of its surface area.

In some examples, the freight car truck includes a secondary suspension spring located under the bolster at the approximate centerline of the nonmetallic plates described above. The secondary suspension spring may comprise a variety of materials, such as a Hytrel® material. The spring may also include several separate components and may or may not include sufficient space within a main spring body where these separate components can be installed. In one example, a characteristic of the secondary suspension spring is to have a sufficient reaction for supporting the vertical load of the freight car body both statically and under dynamic conditions as determined from a dynamic numerical analysis. The vertical deflection of the spring under the vertical load of the freight car body may result in a coupler height within the prescribed requirements of the Association of American Railroads, which height may be a maximum of 35 inches, or less than 32½ inches when the freight car body is unloaded, and may further be a maximum of 33½ inches, or less than 31½ inches when the freight car body is loaded. The secondary suspension spring may be made up of a layered arrangement of natural rubber located between steel plates the number of layers of which can vary depending on the desired characteristics of the spring. The secondary suspension spring may include damping characteristics determined from dynamic numerical analysis sufficient to dissipate energy during various railroad track conditions as specified in Association of American Railroads (AAR) specification M-976 and Chapter 11 resulting in the ATS Steering Truck passing the requirements of the AAR. The secondary suspension spring can be mounted on top of the truck side frame and under the truck bolster either vertically or at a slight cant angle not exceeding 100 degrees.

In certain configurations, the freight car truck has dampers that are connected between the side frame of the truck and the truck bolster, one on each side, and located at diagonally opposite corners of the truck from each other. The dampers may have a damping characteristic determined by dynamic numerical analysis, such that the dampers work in conjunction with the secondary suspension springs to dissipate energy during various railroad track conditions as specified in Association of American Railroads (AAR) specification M-976 and Chapter 11 resulting in the ATS Steering Truck passing the requirements of the AAR. The dampers can achieve damping by utilizing a hydraulic device and proper valving to achieve the desired characteristic. The dampers can be mounted between the side frame of the truck and the truck bolster at an angle relative to vertical determined by dynamic numerical analysis to provide the damping required to pass the requirements of the AAR.

In some aspects, the freight car truck includes a truck side frame designed to space the wheel sets apart longitudinally at a length meeting the AAR requirements for standard wheel set spacing. In one embodiment, this spacing may be about 5 feet 10 inches, but that spacing level can vary depending upon the capacity of the truck. The side frames incorporating pedestals at each end can be designed to accept both the special adapter interface to the roller bearing adapter and the roller bearing adapter itself. A transverse member extends from one of the truck side frames to the side frame on the opposite side of the truck to help maintain proper alignment of the two side frames while still allowing for relative rotation of the side frames to facilitate negotiation of the truck in less than optimum track conditions. The end of the transverse member can be inserted into the opposite side frame and include sufficient clearance and a special bushing that facilitate the relative motion on one side frame to the other. The truck side frames can be fabricated from plate steel sufficient in strength to sustain the loads from a fully loaded freight car including such dynamic loads as may occur during operating in service on the North American railroad interchange system and to meet the requirements of the AAR. In other formats, the truck side frames can be made from a casting or combination of a casting and fabrication. The side frames can be configured so that motion between the side frame and truck bolster is inhibited, limited, or controlled by stops both longitudinally and laterally within specific limits as determined by dynamic numerical analysis.

In some forms, the freight car truck has an interface between the side frame pedestals and the roller bearing adapter that allows for motion of the wheel sets, one relative to the other, such that the wheel sets can take on essentially a radial position when negotiating curves. In certain aspects, the truck may include a steering arm assembly, independent of the vertical load carrying members, such as the truck bolster and side frame, connecting to the roller bearing adapters directly through a bolted attachment.

In some examples, the freight car truck includes wheel sets with inboard roller bearings, wherein the length and weight of the wheel sets is much less than the standard outboard roller bearing wheel set. The wheel sets can be configured so that a wheel can be removed from the axle without having to remove the roller bearing. Such a configuration allows for maintenance savings as compared to outboard roller bearing wheel sets, where it is necessary to remove the roller bearing before the wheel can be removed. The inboard mounting location of the roller bearings can reduce, inhibit, limit, minimize, or even eliminate, axle fretting.

In certain embodiments, the freight car truck has brake beams suspended from the ends of the steering arms with a hanger system so that brake shoes of the brake beams are kept in alignment with the wheel treads as the truck negotiates curved and tangent or straight track. In some examples, the brake beams are connected with a tension member, as opposed to a compression member, such that the brake shoes of the brake beams are kept in alignment with the wheel treads when the brakes are applied as the truck negotiates curved and tangent or straight track. The brake heads of the brake beams are allowed to rotate within fixed limits resulting in even, or substantially even, wear of the brake shoes.

The present disclosure describes preferred embodiments and examples of a rail vehicle, the supporting rail trucks, and related components. Those skilled in the art will recognize that a wide variety of modifications, alterations, and combinations can be made with respect to the above described embodiments without departing from the scope of the invention as set forth in the claims, and that such modifications, alterations, and combinations are to be viewed as being within the ambit of the inventive concept. In addition, it should also be understood that features of one embodiment may be combined with features of other embodiments to provide yet other embodiments as desired. All references cited in the present disclosure and its appendices are hereby incorporated by reference in their entirety.

The invention claimed is:

1. A steering mechanism for a rail vehicle, the steering mechanism comprising:

a first steering arm comprising:

a first pair of support arms that intersect and extend from a first vertex, each support arm spanning from the first vertex toward respective arm ends that form a first side of the steering mechanism, each of the first pair of support arms being configured to attach to a component of a rail car truck; and a first joining component extending from the first vertex away from the first side of the steering mechanism, the first joining component having a first recess;

a second steering arm comprising:

a second pair of support arms that intersect and extend from a second vertex, each support arm spanning from the second vertex toward respective arm ends forming a second side of the steering mechanism that is opposite the first side, each of the second pair of support arms being configured to attach to a component of a rail car truck; and a second joining component extending from the second vertex away from the second side of the steering mechanism and toward the first steering arm, the second joining component having a second recess;

an insert having a first side with a shape configured to mate with the recess of the first joining component, and a second side opposite the first side, the second side having a shape configured to mate with the recess of the second joining component; and at least one articulating device configured to establish an articulated connection between the first steering arm and the second steering arm, wherein the insert and the first and second recesses are configured to maintain a minimum separation between the first and second joining components in a resting assembled state, wherein the minimum separation is sufficient to allow the first and second steering arms to rotate relative to one another, wherein the insert is configured to provide resistance to the relative rotation between the first and second steering arms, wherein first and second steering arms have a V-shaped configuration, and wherein the respective pairs of support arms extend at an angle from the respective vertexes toward respective arm ends.

2. The steering mechanism of claim 1, wherein the minimum separation between the first and second joining components is between about ⅛ inch and about ⅜ inch.

3. The steering mechanism of claim 2, wherein the minimum separation between the first and second joining components is about ¼ of an inch.

4. The steering mechanism of claim 1, wherein the insert comprises a base formed from a rigid material, and wherein the first and second sides of the insert include a flexible material extending from the base, wherein the resistance provided by the insert depends, at least in part, on the flexibility of the flexible material.

5. The steering mechanism of claim 4, wherein the flexible material comprises an elastomeric material.

6. The steering mechanism of claim 4, wherein the flexible material is selected to have a flexibility that is sufficiently stiff to reduce or eliminate hunting while being sufficiently flexible to inhibit rolling resistance of a rail car truck negotiating turns of up to 12 degrees of curvature to 100 pounds or less.

7. The steering mechanism of claim 4, wherein the flexible material is selected to have a flexibility that is sufficiently stiff so that when said steering assembly is used in a truck assembly of an empty car, at 70 mph the lateral acceleration of the car does not to exceed 1.5 g's peak to peak with a maximum standard deviation of 0.13, and wherein said flexible material is sufficiently flexible to inhibit rolling resistance of a rail car truck negotiating turns of up to 12 degrees of curvature to 100 pounds or less.

8. The steering mechanism of claim 1, wherein at least a portion of the insert has a conical shape.

9. The steering mechanism of claim 1, wherein the insert has a central opening, and wherein each of the first and second joining components have an aperture, wherein the joining components and the insert are configured so that the central opening and the apertures of the joining components align in an assembled state.

10. The steering mechanism of claim 9, wherein the articulating device comprises a nut and bolt, wherein the bolt is configured to pass through each of the apertures of the first and second joining components and the central opening of the insert.

11. The steering mechanism of claim 10, further comprising a first sleeve positioned against the first side of the insert within the first joining component, and a second sleeve positioned against the second side of the insert within the second joining component, wherein the second sleeve minimum separation is controlled, at least in part, by the size of the first and second sleeves.

12. A rail car truck assembly comprising:

a first and second side frame extending parallel to a longitudinal axis of the rail car truck assembly;

a first wheel set having a first axle, wheels, and roller bearings, the first wheel set spanning between the first and second side frames on a first side of the rail car truck assembly;

a second wheel set comprising a second axle, wheels, and roller bearings, the second wheel set spanning between the first and second side frames on a second side of the rail car truck assembly opposite the first side; and a steering assembly comprising:

a first steering arm having two support arms that form a V-shape with a first vertex, the two support arms extending from the first vertex and attaching to the individual roller bearings of the first wheel set, the first V-shaped steering arm also having a first joining component that extends from the first vertex on a side opposite the two support arms of the first steering arm, the first joining component having a first recess;

a second steering arm having two support arms that form a V-shape with a second vertex, the two support arms extending from the second vertex and attaching to the roller bearings of the second wheel set, the second V-shaped steering arm also having a second joining component that extends from the second vertex opposite the two support arms of the second steering arm, the second joining component having a second recess;

an insert having a first side with a shape configured to mate with the recess of the first joining component, and an opposing second side with a shape configured to mate with the recess of the second joining component, the insert comprising a base that includes a rigid material, and a flexible material extending from the base along each of the first and second sides, the insert having a conical shape and defining a central opening; and at least one articulating device configured to establish an articulated connection between the first steering arm and the second steering arm, wherein the insert mates with the recesses of the first and second joining components to maintain a minimum separation between the first and second joining components, the minimum separation being sufficient to allow the first and second steering arms to yaw relative to one another, and wherein the insert is configured to provide resistance to the relative rotation between the first and second steering arms, wherein the resistance depends, at least in part, on the flexibility of the flexible material.

13. The rail car truck assembly of claim 12, wherein the individual roller bearings comprise roller bearing adapters, and wherein each steering arm of the steering mechanism is connected to the individual roller bearing adapters of the respective wheel sets via a bolted attachment.

14. The rail car truck assembly of claim 12, wherein the articulating device comprises a clamping assembly, wherein at least a portion of the clamping assembly passes through the first and second joining components and the central opening of the insert, and wherein the clamping assembly clamps the first and second joining components together.

15. The rail car truck assembly of claim 12, further comprising first and second brake beams attached to the respective first and second steering arms via a linkage so that the brake beams are positioned outboard of the wheel sets relative to a center location of the rail car truck assembly.

16. The rail car truck assembly of claim 15, further comprising brake shoes, wherein the steering, mechanism is configured to keep the brake beams and the brake shoes in alignment with the wheels of the first and second wheel sets as the rail car assembly travels along a curved rail track and a straight rail track.

17. The rail car truck assembly of claim 15, wherein the individual brake beams comprise a tensile connector that maintains tension between the individual components of the brake beams.

18. The rail car truck assembly of claim 12, wherein the rail car truck assembly exhibits a rolling resistance of less than about 500 pounds in traveling along a track having a curvature of about 12 degrees.

19. The rail car truck assembly of claim 12, wherein the rail car truck assembly exhibits a rolling resistance of less than about 100 pounds in traveling along a track having a curvature of about 6 degrees.

* * * * *